US007713670B2

(12) United States Patent
Tomita et al.

(10) Patent No.: US 7,713,670 B2
(45) Date of Patent: May 11, 2010

(54) DEVELOPER, AND IMAGE FORMING METHOD USING THE DEVELOPER

(75) Inventors: Masami Tomita, Numazu (JP); Tomio Kondou, Numazu (JP); Masahide Yamashita, Tokyo (JP); Kousuke Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1172 days.

(21) Appl. No.: 11/126,270

(22) Filed: May 11, 2005

(65) Prior Publication Data

US 2005/0260516 A1 Nov. 24, 2005

(30) Foreign Application Priority Data

May 11, 2004 (JP) ..... 2004-141523

(51) Int. Cl.
*G03G 9/08* (2006.01)

(52) U.S. Cl. ..... 430/110.3; 430/111.33; 430/124.1; 430/137.1

(58) Field of Classification Search ..... 430/110.3, 430/111.33, 124.1, 137.1
See application file for complete search history.

(56) References Cited

U.S. PATENT DOCUMENTS

| | | | | |
|---|---|---|---|---|
| 5,476,741 | A * | 12/1995 | Nishikiori et al. | 430/108.8 |
| 5,595,850 | A | 1/1997 | Honjo et al. | |
| 5,915,150 | A * | 6/1999 | Kukimoto et al. | 399/149 |
| 6,171,743 | B1 * | 1/2001 | Nakamura | 430/110.3 |
| 6,287,739 | B1 * | 9/2001 | Kawakami et al. | 430/108.7 |
| 2002/0072006 | A1 * | 6/2002 | Mizoo et al. | 430/108.22 |
| 2003/0068178 | A1 * | 4/2003 | Igarashi | 399/267 |
| 2003/0122911 | A1 * | 7/2003 | Mizoo et al. | 347/95 |
| 2004/0053154 | A1 * | 3/2004 | Tomita et al. | 430/109.4 |

FOREIGN PATENT DOCUMENTS

| | | |
|---|---|---|
| EP | 0 843 225 A2 | 5/1998 |
| EP | 1 128 225 A2 | 8/2001 |
| JP | 2001-318482 | 11/2001 |
| JP | 2002-244400 | 8/2002 |
| JP | 2002-304025 | 10/2002 |

OTHER PUBLICATIONS

Patent Abstracts of Japan, JP 09 325525, Dec. 16, 1997.
Patent Abstracts of Japan, JP 2002-221829 A, Aug. 9, 2002.
U.S. Appl. No. 11/289,488, filed Nov. 30, 2005, Shimojo et al.
U.S. Appl. No. 11/512,385, filed Aug. 30, 2006, Tomita.

(Continued)

*Primary Examiner*—Mark F Huff
*Assistant Examiner*—Rachel L Burney
(74) *Attorney, Agent, or Firm*—Oblon, Spivak, McClelland, Maier & Neustadt, L.L.P.

(57) ABSTRACT

A developer for an electrophotographic tandem image forming method is provided that contains a toner; and a carrier, wherein the toner has a shape factor SF-1 of from 120 to 160, an average circularity of form 0.93 to 0.98, a weight-average particle diameter (D4) of from 3.0 to 8.0 μm, and a ratio (D4/Dn) of the weight-average particle diameter (D4) to a number-average particle diameter (Dn) of from 1.01 to 1.20, and wherein the carrier is almost a spherical ferrite coated with a resin wherein alumina is dispersed, which has an average particle diameter of from 20 to 45 μm and the following formula:

$$(MgO)x(MnO)y(Fe_2O_3)z$$

wherein x is from 1 to 5 mol %, y is from 5 to 55 mol % and z is from 45 to 55 mol %.

20 Claims, 5 Drawing Sheets

OTHER PUBLICATIONS

U.S. Appl. No. 11/608,521, filed Dec. 8, 2006, Satoru et al.
U.S. Appl. No. 11/870,613, filed Oct. 11, 2007, Iwatsuki et al.
U.S. Appl. No. 12/040,451, filed Feb. 29, 2008, Saitoh et al.
U.S. Appl. No. 12/013,108, filed Jan. 11, 2008, Yagi et al.
Japan Image Academy Memoir, 43, pp. 356-357, 2004, published by Hiromichi Kobayashi, Yuji Sato, and Toshio Honjo on Jul. 1, 2006.

* cited by examiner

DEVELOPER, AND IMAGE FORMING METHOD USING THE DEVELOPER

BACKGROUND OF THE INVENTION

1. Field of the Invention

The present invention relates to a developer for forming an electrophotographic image, and to an image forming method using the developer.

2. Discussion of the Background

As a conventional electrophotographic full-color recording method, a method of developing each color image with plural photoreceptors is known.

This method separately forms each color toner image through each latent image forming process, developing process and transfer process, has a small difference between a single color image forming speed and a full color image forming speed, and has an advantage of being capable of meeting specifications for high speed printing. However, since this method forms each color toner image on a separate photoreceptor and layers each color toner layer (color lapping) to form a full color image, when each color toner has different properties such as chargeability, each color toner image has a different developed toner quantity, resulting in large variation of a secondary hue, i.e., deterioration of color reproducibility. In addition, this is same when each photoreceptor has a different chargeability and a different potential after irradiated.

Further, since this method transfers and fixes each toner image formed on the plural photoreceptors on an image forming substrate, when each color toner has a different adherence thereto, the color toner is not stably fixed, resulting in deterioration of color reproducibility. Since a conventional toner prepared by a pulverizing method nonuniformly includes materials dispersed therein in a fracture cross section thereof, surface properties thereof are difficult to fix, and each color toner is difficult to have a stable developed toner quantity and a uniform adherence to the image forming substrate. Accordingly, each color toner has a different developability and transferability, resulting in deterioration of color images. Particularly, since each color toner has a different transferability, color reproducibility thereof tends to deteriorate and an incomplete transfer thereof tends to occur.

Although an intermediate transferer prevents background fouling from directly transferring to a recording medium such as a paper when the photoreceptor has the background fouling, the toner transfers from the photoreceptor to the intermediate transferer and to the recording medium therefrom, and therefore the toner is difficult to have sufficient transferability.

On the other hand, although a conventional polymerized toner prepared by a suspension polymerization method has uniform surface properties, the toner has a spherical shape and has high adherence to the photoreceptor and image forming substrate. Particularly, cleanability of an elastic blade cleaning the photoreceptor and intermediate transferer tends to deteriorate.

As mentioned above, a tandem image forming method is difficult to stably produce high-quality color images for long periods.

Each color toner for use therein needs to have a stable developed toner quantity and a uniform adherence to the photoreceptor and image forming substrate.

Japanese Laid-Open Patent Publication No. 2001-318482 discloses a toner for use in a tandem image forming method, wherein one of the following conditions is satisfied:

(1) the toner has a shape factor having a variation coefficient not greater than 16% and a number particle diameter distribution having a number variation coefficient not greater than 27%; (2) the toner includes a polled toner in an amount not less than 50% by number and has a number particle diameter distribution having a number variation coefficient not greater than 27%; and (3) the toner includes a toner having a shape factor of from 1.2 to 1.6 in an amount not less than 65% by number and has a shape factor having a variation coefficient not greater than 16%.

Japanese Laid-Open Patent Publication No. 2002-244400 discloses a toner for use in a tandem image forming method, wherein the toner has a flat shape and toner images formed thereof are overlaid on an intermediate transferer having an adherence.

Japanese Laid-Open Patent Publication No. 2002-304025 discloses a toner, wherein a relationship between an average circle-equivalent diameter of the toner on a surface of a photoreceptor after an electrostatic latent image is developed and a value derived by dividing a standard deviation thereof with the average circle-equivalent diameter is specified; the toner has a volume-average particle diameter of from 2 to 7 μm; the toner has a volume variation coefficient not greater than 22; the toner includes a toner having a shape factor of from 1.2 to 1.6 in an amount not less than 60% by volume; and the shape factor has a variation coefficient not greater than 18%, and an image forming apparatus wherein a DC voltage overlapped with an AC voltage is applied to a photoreceptor.

Any of these methods specify a particle diameter distribution and a shape of a toner, but even a two-component developer including such a toner does not have stable developability and developing uniformity.

Because of these reasons, a need exists for a toner having good developability and transferability, which is capable of stably producing high-quality color images having good solid image uniformity and thin line reproducibility for long periods in a tandem color image forming method.

SUMMARY OF THE INVENTION

Accordingly, an object of the present invention is to provide a toner or a developer having good developability and transferability, which is capable of stably producing high-quality color images having good solid image uniformity and thin line reproducibility for long periods in a tandem color image forming method.

Another object of the present invention is to provide a toner or a developer capable of producing stable images without defective cleaning for long periods.

These objects and other objects of the present invention, either individually or collectively, have been satisfied by the discovery of a developer for an electrophotographic tandem image forming method, comprising a toner; and a carrier, wherein the toner has a shape factor SF-1 of from 120 to 160, an average circularity of form 0.93 to 0.98, a weight-average particle diameter (D4) of from 3.0 to 8.0 μm, and a ratio (D4/Dn) of the weight-average particle diameter (D4) to a number-average particle diameter (Dn) of from 1.01 to 1.20, and wherein the carrier comprises ferrite particles (most preferably near spherical) coated with a resin wherein alumina is dispersed, which has an average particle diameter of from 20 to 45 μm and the following formula:

$$(MgO)x(MnO)y(Fe_2O_3)z$$

wherein x is from 1 to 5 mol %, y is from 5 to 55 mol % and z is from 45 to 55 mol %.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
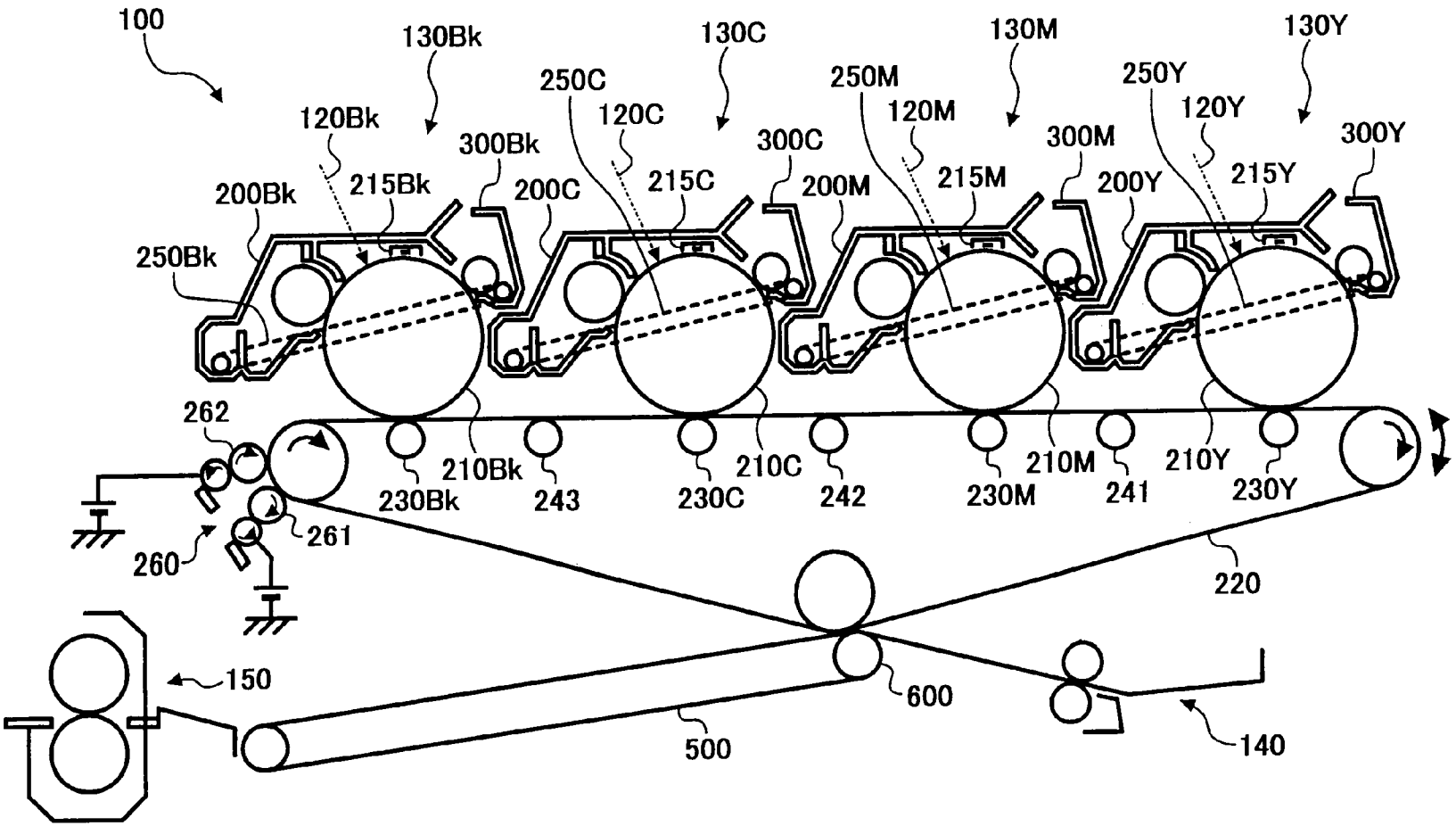
FIG. 1 is a schematic view illustrating an embodiment of the image forming apparatus of the present invention.

The present invention provides a developer having good solid image uniformity, thin line reproducibility and cleanability in a tandem image forming method.

In the present invention, each of at least four photoreceptors develops one color with a color toner or a color developer including the color toner and a carrier, and a color toner image formed therewith is sequentially transferred onto a recording medium, or an intermediate transferer and transferred onto the recording medium at one time.

The tandem image forming method has the above-mentioned advantages and disadvantages, and the object of the present invention is achieved by a toner having a proper particle diameter and a proper shape, and a specified carrier.

Namely, a developer needs to have developability faithful to a latent image and transferability, and particularly the toner needs to uniformly adhere to each color solid and halftone image to stably produce high-quality color images.

The toner of the present invention has a shape factor SF-1 of from 120 to 160, an average circularity of form 0.93 to 0.98, a weight-average particle diameter (D4) of from 3.0 to 8.0 μm, and a ratio (D4/Dn) of the weight-average particle diameter (D4) to a number-average particle diameter (Dn) of from 1.01 to 1.20. The SF-1 is measured by randomly sampling toner images enlarged 1,000 times relative to the original images, which have about 100 particles (or more), using a scanning electron microscope S-800 from Hitachi, Ltd.; and introducing the image information to an image analyzer LUZEX III from NIRECO Corp. through an interface to analyze the information. The SF-1 represents a degree of roundness thereof, and is determined in accordance with the following formula:

$$SF\text{-}1 = MXLNG/\mathrm{AREA} \times \pi/4 \times 100$$

wherein MXLNG represents an absolute maximum length of a particle and AREA represents a projected area thereof.

The SF-1 is preferably from 120 to 160. When greater than 160, the developed image uniformity deteriorates; and the transferability of the toner from a photoreceptor to an intermediate transferer or a transfer paper, or from the intermediate transferer to a recording medium deteriorates. When less than 120, the toner scatters when developing or transferring, resulting in fuzzy images; and remains untransferred on the photoreceptor, resulting in deterioration of the cleanability.

The circularity represents concavity and convexity on the surface of a toner, and is preferably from 0.93 to 0.98 in terms of the developability and transferability. When less than 0.93, the developed image uniformity deteriorates; and the transferability of the toner from a photoreceptor to an intermediate transferer or a transfer paper, or from the intermediate transferer to a recording medium deteriorates. When greater than 0.98, the toner scatters when developing or transferring, resulting in fuzzy images; and remains untransferred on the photoreceptor, resulting in deterioration of the cleanability.

Particularly in the tandem image forming method of the present invention, when the toner has a shape out of the above-mentioned scope, the chargeability of the toner varies, the developed toner quantity varies, a secondary hue of the resultant images largely varies.

The circularity of the toner is specifically measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

Typically, the smaller the toner particle diameter, the more advantageous it is for producing high-resolution and high-quality images. However, it is more disadvantageous for transferability and cleanability of the toner. When the weight-average particle diameter (D4) is less than 3.0 μm, the resultant toner has insufficient fluidity, tends to agglutinate and does not uniformly adhere, resulting in irregularity of image quality. Further, the toner is fusion bonded to the carrier when stirred in an image developer for long periods and deteriorates the chargeability of the carrier, and to members in the image developer, resulting in deficiency of image quality.

When the weight-average particle diameter (D4) is greater than 8.0 μm, the toner has difficulty in producing high-resolution and high-quality images, and at the same time, the variation in particle diameter thereof becomes large developing uniformity thereof deteriorates in many cases, when the toner is consumed and fed in a developer. This is same when a ratio (D4/Dn) of the weight-average particle diameter (D4) to a number-average particle diameter (Dn) of the toner becomes greater than 1.20.

The weight-average particle diameter (D4) to a number-average particle diameter (Dn) can be measured by a Coulter Counter TA-II or a Coulter Multisizer from Coulter Electronics, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

The weight-average particle diameter (D4) is determined from the weight distribution, and the number-average particle diameter (Dn) is determined from the number distribution.

The carrier of the present invention comprises ferrite core material particles coated with a resin wherein alumina is dispersed, which has an average particle diameter of from 20 to 45 μm and the following formula:

$$(MgO)x(MnO)y(Fe_2O_3)z$$

wherein x is from 1 to 5 mol %, y is from 5 to 55 mol % and z is from 45 to 55 mol %. The carrier may include other constituents such as impurities and constituents due to substitution and addition, as long as the above-mentioned formula is satisfied. Specific examples of the other constituents include, but are not limited to, $SnO_2$, SrO, alkaline earth metal oxides, $Bi_2O_5$ and ZrO. Most preferably, the ferrite particles are near spherical or spherical in shape.

The carrier has two functions. One is to feed the toner to a developing area and the other is to charge the toner in an image developer wherein the carrier and toner are stirred.

Particularly, the carrier of the present invention has good fluidity in the image developer and is capable of uniformly feeding the toner, i.e., a latent image is uniformly developed. Further, the uniform developed toner layer can uniformly be transferred as well.

The average particle diameter of the carrier is preferably measured by a MICROTRAC particle analyzer Type 7995 from LEEDS & NORTHRUP CO. with a particle diameter range of from 0.7 to 125 μm.

In addition, a latent image can uniformly be developed with a developer including the carrier of the present invention and a toner even when the properties of the toner slightly vary.

The carrier of the present invention is considered to have good fluidity because of its constituents and a balance of its particle diameter and shape. When the constituents are different, the carrier agglutinates or scatters in the image developer. When the average particle diameter is less than 20 μm, the carrier agglutinates or scatters. When greater than 45 μm, the toner is not uniformly fed, and the carrier coarsely fuzzes, resulting in deterioration of solid and halftone image quality.

Specific examples of the resin coating the surface of the carrier include, but is not limited to, an acrylic resin and/or a silicone resin. These resins make the above-mentioned core material strongly exert an effect of uniformly feeding and charging the toner. The acrylic resin has high adhesiveness and low brittleness, and therefore has very good abrasion resistance. However, since the acrylic resin has a high surface energy, charge quantity thereof lowers when combined with a toner tending to be spent (fusion bonded on the surface of the carrier). However, when combined with the silicone resin having low surface energy and the spent toner is difficult to accumulate thereon, this problem can be solved. However, the silicone resin has low adhesiveness and high brittleness, and therefore has poor abrasion resistance. Therefore, it is important to use the two resins in a balanced manner, and which enables the carrier to be coated with a film the spent toner is difficult to occur on, and having abrasion resistance. The acrylic resin is preferably included in an amount of fro 10 to 90% by weight based on total weight of the resin coating the surface of the carrier. When less than 10% by weight, the silicone resin mostly coats the carrier, resulting in poor abrasion resistance because of the high brittleness of the silicone resin. When greater than 90% by weight, the acrylic resin mostly coats the carrier, resulting in accumulation of the spent toner because of high surface energy of the acrylic resin.

The acrylic resin in the present invention represents all resins including an acrylic constituent, and is not particularly limited. The acrylic resin can be used alone, and a combination with at least one other constituent crosslinking therewith can also be used. Specific examples of the other constituent crosslinking therewith include, but is not limited to, an amino resin and an acidic catalyst. Specific examples of the amino resin include, but is not limited to, a guanamine resin and a melamine resin. Specific examples of the acidic catalyst include, but is not limited to, any materials having a catalytic influence. Specific examples thereof include, but is not limited to, materials having a reactive group such as a complete alkyl group, a methylol group, an imino group and a methylol/imino group.

Specific examples of the silicone resin include, but is not limited to, any known silicone resins such as straight silicones and silicones modified with a resin such as an alkyd resin, a polyester resin, an epoxy resin, an acrylic resin and a urethane resin. Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), EX1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

As mentioned above, a combination of the acrylic resin and silicone resin satisfies spent toner resistance, abrasion resistance and adhesiveness required for the coated film of the carrier. Specifically, the acrylic resin is used for an adhesive layer to strengthen the adhesiveness thereof to the core material, and the silicone resin is used as the coated film, but are not limited thereto.

A particulate alumina or a particulate surface-treated alumina is preferably dispersed in the resin-coated layer of the carrier such that the toner can negatively be charged.

The particulate alumina or particulate surface-treated alumina is dispersed in the resin-coated layer of the carrier such that the coated layer is protected from an external force applied to the surface of the carrier. The particulate alumina or particulate surface-treated alumina can protect the coated layer from the external force for long periods. The particulate alumina or particulate surface-treated alumina preferably has a particle diameter not greater than 5 μm, and is preferably dispersed in the acrylic resin having strong adhesiveness to hold the particulate alumina or particulate surface-treated alumina for long periods, but is not necessarily dispersed therein.

Further, the resin-coated layer effectively includes carbon black. The carbon black decreased high resistivity of the resin-coated layer or resin-coated layer including the particulate alumina or particulate surface-treated alumina. Typically when a carrier having high resistivity is used in a developer, the resultant copy image having a large area has high edge effect (the center of the image has very low density and only the edge has high density). Letters and thin lines are clearly produced because of the edge effect, but a halftone image is very poorly produced. Therefore, when the carbon black is properly used, quality images can be produced, and further the carbon black can be used for a carrier for a color developer.

When the coated film of the carrier for a color developer, including carbon black, is peeled off therefrom and mixed in an image, the image is a defective image because the coated film is clearly noticeable therein. However, in the present invention, since the coated film includes an acrylic resin having high adhesiveness and being difficult to wear, the coated film strongly holds the carbon black and the carbon black scarcely leave from the carrier. Particularly, the carbon black dispersed in the acrylic resin can avoid defective images, i.e., the carrier formed of a core material, an acrylic resin layer wherein the carbon black is dispersed on the core material, and a silicone resin layer not including the carbon black on the acrylic resin layer can more effectively avoid defective images. In the present invention, any carbon black typically used for a carrier and a toner can be used. On the other hand, the carbon black cannot be used in the silicone resin having high brittleness and being easy to wear because a peeled black film appears in an image.

The carrier of the present invention is prepared by a method of fully dispersing the resin and particulate alumina or surface-treated alumina to prepare a resin-coated film forming liquid, coating the liquid on the surface of the carrier and drying the liquid.

Particularly when a toner is prepared in a liquid phase, when at least a hard particulate material having an average primary particle diameter of from 0.01 to 0.3 μm is included therein, the shape of the toner can be controlled as desired. When less than 0.01 μm, the shape of the toner cannot be controlled as desired. When greater than 0.3 μm, the toner becomes brittle and easy to break.

When a spherical (or near spherical) inorganic particulate material having an average particle diameter of from 0.05 to 0.6 μm is adhered to the surface of the toner, variations of charge quantity or developability thereof due to burial of an external additive therein when stirred in an image developer can be improved. When not spherical or smaller than 0.05 μm, the inorganic particulate material tends to be buried in the surface of the toner and the charge quantity or developability there of occasionally varies. When larger than 0.6 μm, adherence thereof to the surface of the toner deteriorates, and the inorganic particulate material occasionally leaves therefrom, contaminates the surface of the carrier and impairs the chargeability thereof.

When the toner includes a release agent of from 3 to 10% by weight, a fixing oil can be dispensed or decreased. The release agent effectively imparts releasability to the toner when fixed, but has an adverse effect in many cases when developed. When less than 3% by weight, the resultant toner does not have sufficient releasability. When greater than 10% by weight, the release agent occasionally leaves therefrom, adheres to the surface of the carrier and impairs the chargeability thereof. Further, the fluidity of the toner deteriorates and a uniform toner layer is not formed on a photoreceptor.

Specific examples of the release agent include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanates such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanates such as ethylenediaminebehenylamide; polyalkylamides such as tristearylamidetrimellitate; and dialkylketones such as distearylketone. The release agent preferably has a melting point of from 50 to 120° C., and more preferably of from 60 to 90° C. A release agent having a melting point less than 40° C. has an adverse effect on its thermostability, and a release agent having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A release agent having a melting viscosity greater than 1,000 cps makes it difficult to improve hot offset resistance and low temperature fixability of the resultant toner. When less than 5 cps, the thermostability thereof tends to deteriorate.

The toner of the present invention is prepared by dispersing a microscopic droplet including at least an organic solvent, a binder resin and a colorant in an aqueous medium including a particulate resin material to prepare a dispersion; and removing the organic solvent therefrom.

Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran. The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

Specific examples of methods of preparing the toner of the present invention include, but are not limited to, (1) a method of melting and kneading toner constituents to prepare a kneaded toner constituents, pulverizing the kneaded toner constituents to prepare a pulverized toner constituents, and classifying the pulverized toner constituents; (2) a method of suspending and polymerizing a radical polymerizing monomer constituents including a colorant and a chain transfer agent in an aqueous medium; and (3) a method of emulsion polymerizing a radical polymerizing monomer constituents including a chain transfer agent in an aqueous medium using a water-soluble polymerization initiator to prepare a particulate resin material, and fusion bonding the particulate resin material in the aqueous medium. Particularly, (4) a method of dispersing a microscopic droplet including at least an organic solvent, a binder resin and a colorant in an aqueous medium including a particulate resin material to prepare a dispersion; and removing the organic solvent therefrom is preferably used, and (5) a method of dissolving or dispersing a prepolymer formed of a polyester resin having an isocyanate group, a compound performing an elongation or a crosslinking reaction with the prepolymer and toner constituents in an organic solvent to prepare a solution or a first dispersion; and subjecting the solution or dispersion to an elongation and/or a crosslinking reaction in an aqueous medium to prepare a second dispersion; and removing the solvent from the second dispersion is more preferably used.

The polyester prepolymer having an isocyanate group can be formed from a reaction between polyester having an active hydrogen atom formed by polycondensation between a polyol (PO) and a polycarboxylic acid (PC), and polyisocyanate (PIC). Specific examples of the groups including the active hydrogen include a hydroxyl group (such as an alcoholic hydroxyl group and a phenolic hydroxyl group), an amino group, a carboxyl group, a mercapto group, etc. In particular, the alcoholic hydroxyl group is preferably used.

As the polyol (PO), diol (DIO) and triol (TO) can be used, and the DIO alone or a mixture of the DIO and a small amount of the TO is preferably used.

Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

A content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of amines (B) reacting with the polyester prepolymer (A) include polyamines and/or monoamines having a group including an active hydrogen. The group including an active hydrogen includes a hydroxyl group and a mercapto group. Such amines include diamines, ketimine compounds and oxazoline compounds.

Further, when the prepolymer (A) and the amine (B) are reacted with each other, the molecular weight of the modified polyesters (i) can optionally be controlled using an elongation anticatalyst, if desired. Specific examples of the elongation anticatalyst include monoamines not having a group having an active hydrogen such as diethyl amine, dibutyl amine, butyl amine and lauryl amine, and blocked amines, i.e., ketimine compounds prepared by blocking the monoamines mentioned above. The content thereof is properly determined according to a desired molecular weight of the resultant urea-modified polyester.

A mixing ratio (i.e., a ratio [NCO]/[NHx]) of the content of the prepolymer (A) having an isocyanate group to the amine (B) is from ½ to 2/1, preferably from 1.5/1 to 1/1.5 and more preferably from 1.2/1 to 1/1.2. When the mixing ratio is greater than 2 or less than ½, the molecular weight of the resultant polyester decreases, resulting in deterioration of hot offset resistance of the resultant toner.

In the present invention, when the prepolymer (A) including an isocyanate group and the amine (B) are reacted with each other in an aqueous medium, a polyester resin D unreactive with the amine can optionally be included therein. The polyester resin D preferably has a glass transition temperature (Tg) of from 35 to 65° C., and more preferably from 45 to 60° C. In addition, the polyester resin D preferably has a number-average molecular weight of from 2,000 to 10,000, and more preferably from 2,500 to 8,000. The polyester resin D includes a urea-modified polyester (UMPE) which may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester resin (UMPE) can be produced by known methods such as a one-shot method. The weight-average molecular weight of the modified polyester resin is not less than 10,000, preferably from 20,000 to 500, 000, and more preferably from 30,000 to 100,000. When the weight-average molecular weight is less than 10,000, hot offset resistance of the resultant toner deteriorates.

In the present invention, an unmodified polyester resin (PE) can be used in combination with the optional modified polyester resin (UMPE) as a toner binder resin. It is more preferable to use the unmodified polyester resin (PE) in combination with the modified polyester resin than to use the modified polyester resin alone because low-temperature fixability and glossiness of full color images of the resultant toner improve. Specific examples of the unmodified polyester resin (PE) include polycondensed products between the polyol (PO) and polycarboxylic acid (PC) similarly to the modified polyester resin (i), and the components preferably used are the same as those thereof. It is preferable that the modified polyester resin (UMPE) and unmodified polyester resin (PE) are partially soluble with each other in terms of the low-temperature fixability and hot offset resistance of the resultant toner. Therefore, the modified polyester resin (UMPE) and unmodified polyester resin (PE) preferably have similar constituents. When the unmodified polyester resin (PE) is used in combination, a weight ratio ((UMPE)/(PE)) between the modified polyester resin (UMPE) and unmodified polyester resin (PE) is from 5/95 to 80/20, preferably from 5/95 to 30/70, more preferably from 5/95 to 25/75, and most preferably from 7/93 to 20/80. When the modified polyester resin (UMPE) has a weight ratio less than 5%, the resultant toner has poor hot offset resistance, and has difficulty in having thermostability and low-temperature fixability.

The unmodified polyester resin (PE) preferably has a hydroxyl value not less than 5 mg KOH/g. In addition, the unmodified polyester resin (PE) preferably has an acid value of from 1 to 30, and more preferably from 5 to 20 mg KOH/g. When the unmodified polyester resin (PE) has such an acid value, the resultant toner tends to be negatively charged and has good affinity for papers, and therefore the low-temperature fixability thereof improves. When greater than 30, charge stability thereof against environmental variation deteriorates. In a polyaddition reaction between the prepolymer (A) and the amine (B), the emulsification becomes difficult to control when the acid value of the unmodified polyester resin (PE) varies.

In the present invention, the toner binder preferably has a glass transition temperature (Tg) of from 45 to 65° C., and more preferably from 45 to 60° C. When less than 45° C., the thermostability of the resultant toner deteriorates. When greater than 65° C., the resultant toner has insufficient low-temperature fixability.

Specific examples of the colorants for use in the present invention include any known dyes and pigments such as carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The content of the colorant in the toner is preferably from 1 to 15% by weight, and more preferably from 3 to 10% by weight, based on total weight of the toner.

The colorant for use in the present invention can be used as a master batch pigment, if desired, when combined with a resin. Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed, can be preferably used because the resultant wet cake of the colorant can be used as it is. In this case, a three roll mill is preferably used for kneading the mixture upon application of high shearing stress.

The toner of the present invention may optionally include a charge controlling agent to have proper chargeability. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. The charge controlling agent is preferably a crystalline compound and is easily breakable by a stress or the like to microscopic particles having a size of about 1 μm. The charge controlling agent can previously be in a particulate resin including a colorant to reinforce the chargeability of the resultant toner. The charge controlling agent is preferably mixed with the particulate resin including a colorant in an amount of 0.01 to 2 parts by weight, more preferably from 0.05 to 1 parts by weight, and most preferably from 0.1 to 0.5 parts by weight per 100 parts of the particulate resin including a colorant.

The toner of the present invention can preferably include an inorganic particulate material as an external additive to assist the fluidity, developability and chargeability thereof. Particularly, a hydrophobic silica and a hydrophobic titanium oxide are preferably used. The inorganic particulate material preferably has a primary particle diameter of from 5 nm to 2 μm, and more preferably from 5 nm to 0.5 μm. In addition, a specific surface of the inorganic particulates measured by a BET method is preferably from 20 to 500 $m^2/g$. The content of the external additive is preferably from 0.01 to 5% by weight, and more preferably from 0.01 to 2.0% by weight based on total weight of the toner.

Specific preferred examples of suitable inorganic particles include alumina, barium titanate, magnesium titanate, calcium titanate, strontium titanate, zinc oxide, tin oxide, quartz sand, clay, mica, sand-lime, diatomearth, chromium oxide, cerium oxide, rediron oxide, antimony trioxide, magnesium oxide, zirconium oxide, barium sulfate, barium carbonate, calcium carbonate, silicon carbide, silicon nitride, etc.

Specific preferred examples of other suitable polymer particulate materials include polystyrene formed by a soap-free emulsifying polymerization, a suspension polymerization or a dispersing polymerization, methacrylate ester or acrylate ester copolymers, silicone resins, benzoguanamine resins, polycondensation particles such as nylon and polymeric particles of thermosetting resins.

A surface treatment agent can increase the hydrophobicity of these fluidizers and prevent deterioration of fluidity and chargeability of the resultant toner even in high humidity. Any desired surface treatment agent may be used, depending on the properties of the treated particle of interest. Specific preferred examples of the surface treatment agent include silane coupling agents, silylating agents, silane coupling agents having an alkyl fluoride group, organic titanate coupling agents, aluminium coupling agents silicone oils and modified silicone oils.

The toner of the present invention may also include a cleanability improver for removing a developer remaining on a photoreceptor or an intermediate transferer after transfer. Specific examples of the cleanability improver include fatty acid metallic salts such as zinc stearate, calcium stearate and stearic acid; and polymeric particles prepared by a soap-free emulsifying polymerization method such as polymethylmethacrylate particles and polystyrene particles. The polymeric particles have a comparatively narrow particle diameter distribution and preferably have a volume-average particle diameter of from 0.01 to 1 μm.

Next, a method of preparing the toner of the present invention will be explained in detail.

First, an oil dispersion wherein a polyester prepolymer including an isocyanate group A is dissolved in an organic solvent, a colorant is dispersed and a release agent is dissolved or dispersed is prepared.

The oil dispersion is pulverized by a wet pulverizer to pulverize and uniformly disperse the colorant therein for 30 to 120 min.

Next, the oil dispersion is emulsified in the presence of an inorganic particulate material and/or a particulate polymeric material to form an oil-in-water emulsion and a urea-modified polyester resin C produced by a reaction between the polyester prepolymer including an isocyanate group A and an amine B.

Specific examples of the organic solvent include organic solvents dissolving polyester resins, and which is insoluble, hardly soluble or slightly soluble in water. The organic solvent preferably has a boiling point of from 60 to 150° C., and more preferably from 70 to 120° C. Specific examples of such an organic solvent include ethyl acetate, methyl ethyl ketone, etc.

In the present invention, the above-mentioned master batch pigment is preferably used as a colorant to uniformly and effectively disperse the colorant.

In the present invention, a polyester resin unreactive with the amine D is preferably dissolved in the organic solvent as a supplement. Further, the polyester resin D can be dispersed in the aqueous medium.

When the oil dispersion is dispersed in the aqueous medium in the present invention, the dispersion method is not particularly limited, and low-speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. The temperature is preferably higher because the dispersion has a low viscosity and is easy to disperse when dispersed.

The content of the aqueous medium to 100 parts by weight of the toner constituents such as the prepolymer A, colorant, release agent and polyester resin D is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have the desired particle diameter. In contrast, when the content is greater than 2,000, the production cost increases. A dispersant can preferably be used to prepare a stably dispersed dispersion including particles having a sharp particle diameter distribution.

The oil dispersion is preferably dispersed in the aqueous medium as quickly as possible.

The aqueous medium for use in the present invention may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

Specific preferred examples of the dispersants used to emulsify and disperse an oil phase in an aqueous liquid in which the toner constituents are dispersed, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

In the present invention, a surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10) -N-ethylsulfonylglycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Inorganic particulate materials such as tricalcium phosphate, calcium carbonate, titanium oxide, colloidal silica and hydroxyapatite, which are insoluble or hardly soluble in water, can also be used.

In addition, hydrophobic particulate polymeric materials such as hydrocarbon resins, fluorine-containing resins and hydroxyapatite, which are insoluble or hardly soluble in water, can also be used.

The particulate materials have a particle diameter smaller than that of the toner, and preferably has a ratio (an average particle diameter of the particulate material/the weight-average particle diameter of the toner) of from 0.001 to 0.3. When greater than 0.3, the particulate materials do not effectively adhere to the surface of the toner, the resultant toner tends to have a wide particle diameter distribution.

The average particle diameter of the particulate material can properly be controlled in a range of the above-mentioned ratio such that the resultant toner has a desired particle diameter.

The average particle diameter of the particulate material is preferably from 0.0025 to 1.5 μm, and more preferably from 0.005 to 1.0 μm for the toner having a weight-average particle diameter of 5 μm. In addition, the average particle diameter of the particulate material is preferably from 0.05 to 3 μm, and more preferably from 0.05 to 2.0 μm for the toner having a weight-average particle diameter of 10 μm.

In the present invention, the aqueous medium can include various hydrophilic polymeric materials forming a polymeric protection colloid therein as a dispersion stabilizer.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

To remove a fluid medium from an emulsified dispersion prepared by a polyaddition reaction between the prepolymer A and amine B, a method of gradually raising the temperature of the whole dispersion in a process of removing the fluid medium to remove the organic solvent by vaporizing can be used. The circularity of the resultant toner can be controlled by a strength of stirring the emulsified dispersion before removing the organic solvent and a time therefor. The more slowly the organic solvent is removed, the more spherical the resultant toner becomes, having a circularity not less than 0.980. The more strongly and quickly the organic solvent is removed, the more concavo-convex or amorphous the resultant toner becomes, having a circularity of from 0.900 to 0.950. Removing the fluid medium from the emulsified dispersion while strongly stirring the emulsified dispersion in a stirring tank at 30 to 50° C. can control the circularity of the resultant toner in a range of from 0.820 to 0.990. This is because the organic solvent such as ethyl acetate is removed from the dispersion so quickly that a volume contraction thereof is considered to occur.

In addition, a method of spraying the emulsified dispersion in dry air, completely removing the organic solvent therefrom to form toner particles and removing an aqueous dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

The organic solvent is preferably removed from the emulsified dispersion in a short time, and specifically in 25 hrs.

When an acid such as calcium phosphate or a material soluble in alkaline is used as an inorganic particulate material, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the reaction between the prepolymer A and amine B.

Further, to decrease viscosity of the dispersion, a solvent which can dissolve the prepolymer or urea-modified polyester can be used because the resultant particles have a sharp particle diameter distribution. The solvent is preferably volatile and has a boiling point lower than 100° C., from the viewpoint of being easily removed from the dispersion after the particles are formed. Specific examples of such a solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer A used. When such a solvent is used to prepare a particle dispersion, the solvent is removed therefrom under a normal or reduced pressure after the reaction between the prepolymer A and amine B.

The reaction time between the prepolymer A and amine B depends on reactivity of the isocyanate structure of the prepolymer A and amine B, but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

When the emulsified dispersion is washed and dried while maintaining a wide particle diameter distribution thereof, the dispersion can be classified to have a desired particle diameter distribution. A cyclone, a decanter, a centrifugal separation, etc. can remove particles in a dispersion liquid. The powder remaining after the dispersion liquid is dried can be classified, but the liquid is preferably classified in terms of efficiency.

Heterogeneous particles such as release agent particles, charge controlling particles, fluidizing particles and colorant particles can optionally be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Next, the image forming apparatus of the present invention will be explained, but is not limited thereto.

FIG. 1 is a schematic view illustrating an embodiment of the image forming apparatus of the present invention. In FIG. 1, a main body 100 mainly includes image writing units 120Bk, 120C, 120*m* and 120Y; image forming units 130Bk, 130C, 130*m* and 130Y; and a paper feeder 140. An image processor (not shown) converts an image signal into each color signal, i.e., black (Bk), cyan (C), magenta (M) and yellow (Y), and transmits the each color signal to the image writing units 120Bk, 120C, 120*m* and 120Y. Each of the image writing units 120Bk, 120C, 120*m* and 120Y is a laser scanning optical system including, e.g., a laser beam source, a polarizer such as a polygon mirror, a scanning image formation optical system and mirrors (not shown), and writes an image on photoreceptors 210Bk, 210C, 210M and 210Y as image bearers formed in the image forming units 130Bk, 130C, 130*m* and 130Y. The photoreceptors 210Bk, 210C, 210M and 210Y for each color are typically organic photoreceptors. Around each photoreceptor 210Bk, 210C, 210M and 210Y, chargers 215Bk, 215C, 215M and 215Y; laser beam irradiators of the image writing units 120Bk, 120C, 120*m* and 120Y; image developers 200Bk, 200C, 200M and 200Y for each color; first transferers 230Bk, 230C, 230M and 230Y; cleaners 300Bk, 300C, 300M and 300Y; and dischargers (not shown) are located. Each of the image developers 200Bk, 200C, 200M and 200Y uses a two-component magnetic brush developing method. An intermediate transfer belt 220 stands between photoreceptors 210Bk, 210C, 210M and 210Y; and first transferers 230Bk, 230C, 230M and 230Y. Each color toner image is sequentially transferred onto the intermediate transfer belt 220 and overlapped thereon.

Electroconductive rollers 241, 242 and 243 are located among first transferers 230Bk, 230C, 230M and 230Y. A transfer paper fed from the paper feeder 140 is borne by a transfer belt 500, and the toner image on the intermediate transfer belt 220 is transferred on to the transfer paper by a second transfer roller 600 at a position where the intermediate transfer belt 220 and the transfer belt 500 contact each other.

Then, the transfer paper the toner image has been transferred onto is transported by the transfer belt 500 to a fixer 150, where the image is fixed on the transfer paper. The untransferred toner remaining on the intermediate transfer belt 220 is removed by an intermediate transfer belt cleaner 260.

Since the toner on the intermediate transfer belt 220 before transferred onto the transfer paper has a negative polarity as it does when developed, a positive transfer bias voltage is applied to the second transfer roller 600 to transfer the toner onto the transfer paper. The untransferred toner remaining on the intermediate transfer belt 220 is discharged to have nil or a positive polarity at the moment the intermediate transfer belt 220 and the transfer paper separate from each other.

When the transfer paper is jammed or a toner image is formed on a non-image forming area, the toner keeps a negative polarity because the toner is not affected by the second transfer.

Next, the image developer will be explained in detail. Since all the image developers 200Bk, 200C, 200M and 200Y have same constitutions, only the image developer for black color 200Bk will be explained, and the explanations of the other image developers 200C, 200M and 200Y are omitted.

Figure 2:
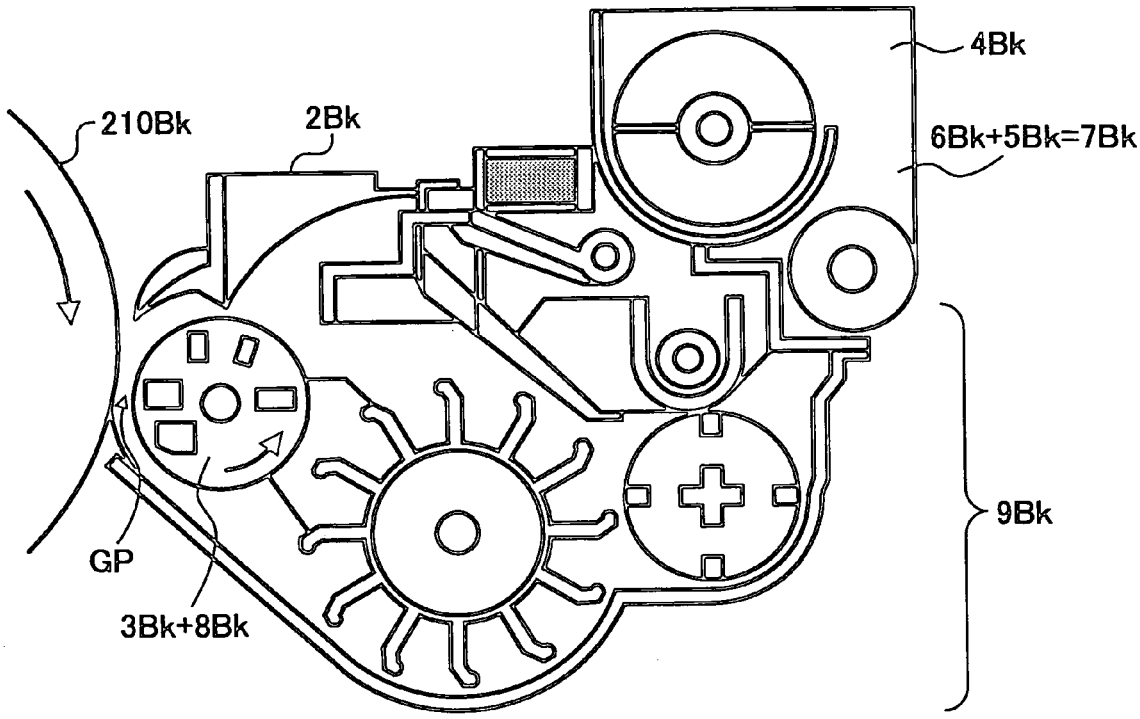
FIG. 2 is a schematic view illustrating a black image developer.

FIG. 2 is a schematic view illustrating a black image developer. In FIG. 2, the black image developer 200Bk mainly includes the photoreceptor 210Bk, a doctor 2Bk as a regulator, a developing sleeve 3Bk as a toner bearer and a hopper 4Bk. The hopper 4Bk includes a two-component developer 7Bk including a toner 6Bk and a magnetic particulate material 5Bk.

The developing sleeve 3Bk is a non-magnetic and rotatable sleeve, and includes plural magnets 8Bk. The magnets are fixed to apply magnetic force to the developer when passing a predetermined position. In this embodiment, the developing sleeve 3Bk has a diameter of 18 mm, and the surface thereof is sandblasted to be in a range of from 10 to 30 μm RZ or is formed to have plural grooves having a depth of from 1 to a few mm. The magnet 8Bk has five magnetic poles N1, S1, N2, S2 and S3 wherein S and N are alternately in line from the doctor 2Bk in rotation direction of the developing sleeve 3Bk. The toner 6Bk and magnetic particulate material 5Bk are borne by the developing sleeve 3Bk as a developer, and the toner 6Bk has a specific charge quantity when mixed with the magnetic particulate material 5Bk. In this embodiment, the toner 6Bk preferably has a charge quantity of from −10 to −30 μc/g. The developing sleeve 3Bk is located in the S1 area of the magnet 8Bk a magnetic brush of the developer 7Bk is formed on, facing the photoreceptor 210Bk.

The doctor 2Bk contacts the magnetic brush (not shown) of the developer 7Bk formed on the developing sleeve 3Bk, facing the developing sleeve 3Bk. The developing sleeve 3Bk rotates in a direction indicated by an arrow in FIG. 2. The developing sleeve 3Bk develops a latent image on the photoreceptor 210Bk, contacting thereto. The photoreceptor 210Bk is a drum type including a tube made of aluminum, etc. an organic photoconductive material having photoconductivity is coated on to form a photosensitive layer thereon.

The developer 7Bk included in the hopper 4Bk is a mixture of the toner 6Bk and magnetic particulate material 5Bk, and is stirred by a stirrer/feeder (not shown), the rotation of the developing sleeve 3Bk and magnetic force of the magnet 8Bk, when the toner 6Bk is charged by friction with the magnetic particulate material 5Bk. On the other hand, the developer 7Bk borne by the developing sleeve 3Bk is regulated by the doctor 2Bk such that a specific amount of the developer 7Bk is borne by the developing sleeve 3Bk, and the rest of the developer 7Bk is returned into a developer container 9Bk. A gap at the closet point between the doctor 2Bk and developing sleeve 3Bk is 500 μm, and the magnetic pole N1 of the magnet 8Bk facing the doctor 2Bk is located upstream of the rotation direction of the developing sleeve 3Bk at a slant of a few degrees. This easily can form a circulating flow such that the developer 7Bk returns from the doctor 2Bk.

Particularly in the present invention, only a DC voltage is preferably applied to a developer bearer located in an image developer in the image forming method of the present invention.

Typically, when developing a color image, an alternate electric field is overlapped with a direct electric field so that the developer bearer can have high developability. However, when the alternate electric field is applied thereto, the toner tends to disperse or scatter when developing. Particularly in a tandem method, since dispersed toner layers of each color on a latent image are transferred onto a transfer medium or an intermediate transferer as they are, even a microscopic image distortion is accentuated when developed to affect the resultant image in many cases.

A latent image formed on the photoreceptor 210Bk is developed and visualized with the toner 6Bk of the developer 7Bk on the developing sleeve 3Bk upon application of developing bias thereto. In this embodiment, the photoreceptor 210Bk has a linear velocity of 200 mm/s, and the developing sleeve 3Bk has a linear velocity of 240 mm/s. The photoreceptor 210Bk has a diameter of 50 mm, and the developing sleeve 3Bk has a diameter of 18 mm. The toner on the developing sleeve 3Bk has a charge quantity of from −10 to −30 μc/g. A developing gap GP between the photoreceptor 210Bk and the developing sleeve 3Bk can have a range of from 0.8 mm to 0.4 mm, and the smaller the gap, the more improved the developing efficiency.

The photosensitive layer has a thickness of 30 μm, and the optical system has a beam spot diameter of 50×60 μm and a light quantity of 0.47 mW. The photoreceptor 210Bk has a potential before irradiated VO of −700 V and a potential after irradiated VL of −120 V, and the developing bias voltage is −470 V, i.e., the developing potential is 350 V. The visualized image formed on the photoreceptor 210Bk with the toner 6Bk is then transferred onto the intermediate transferer and onto the transfer paper, and fixed thereon. The visualized image is transferred onto the intermediate transfer belt 220 from the photoreceptor 210Bk, 210C, 210M and 210Y upon application of bias to the first transferer 230Bk, 230C, 230M and 230Y, and further transferred onto the transfer paper upon application of bias to the second transfer roller 600.

Next, the cleaner will be explained. In FIG. 1, each of the image developers 200Bk, 200C, 200M and 200Y and each of the cleaners 300Bk, 300C, 300M and 300Y is connected to each other through each toner feeding pipe 250Bk, 250C, 250M and 250Y (dash line in FIG. 1). Each of the toner feeding pipe 250Bk, 250C, 250M and 250Y includes a screw (not shown), the toner collected by each of the cleaners 300Bk, 300C, 300M and 300Y is transported into each of the image developers 200Bk, 200C, 200M and 200Y.

In the conventional direct transfer method of using a combination of four (4) photoreceptor drums and a belt transport, a paper dust adheres to the photoreceptor because a transfer paper directly contacts the photoreceptor. Therefore, the collected toner includes the paper dust, resulting in deterioration of the resultant images such as white spotted images. Further, in the conventional method of using a combination of one (1) photoreceptor drum and an intermediate transferer, although the photoreceptor drum is free from the paper dust, separating the mixed color toner remaining thereon into each color toner to recycle the toner is practically impossible. Although it is suggested that the mixed color toner is used as a black toner, the mixed color toner does not have a black color and the color thereof varies according to a print mode. In the present invention, the intermediate transfer belt 220 decreases the paper dust in the toner and adherence of the paper dust to intermediate transferer is also prevented. Since each of the photoreceptors 210Bk, 210C, 210M and 210Y uses an independent color toner, each of the cleaners 300Bk, 300C, 300M and 300Y does not have to contact or separate from each of the photoreceptors 210Bk, 210C, 210M and 210Y, and only the toner can be collected.

The positively-charged toner remaining on the intermediate transfer belt 220 is cleaned by an electroconductive fur brush 262 a negative voltage is applied to. A positive voltage is applied to an electroconductive fur brush 261. Almost all the untransferred toners remaining on the photoreceptors 210Bk, 210C, 210M and 210Y are cleaned by the electroconductive fur brushes 261 and 262. Toners, paper dusts, talcs, etc. which are not cleaned by the electroconductive fur brush 262 are negatively-charged thereby. Since the black image is transferred with a positive voltage, such negatively-charged toners, paper dusts and talcs are attracted by the intermediate transfer belt 220, and a transfer thereof to the photoreceptor 210Bk can be prevented.

When 50,000 full-color images were produced by the image forming apparatus of the present invention, the images were good with less stripes due to a damage of the photoreceptor caused by the paper dust and due to the paper dust stuck between the blade and photoreceptor. Further, abnormal image caused by the intermediate transfer belt was not produced at all.

Next, the intermediate transfer belt 220 for use in the image forming apparatus of the present invention will be explained. The intermediate transfer belt 220 is an elastic belt formed of three layers including a resin layer, an elastic layer and a surface layer.

Specific examples of resin materials for use in the resin layer include polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination. However, these are not limited thereto.

Specific examples of elastic rubbers and elastomers for use in the elastic layer include a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlorosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer; etc. These can be used alone or in combination. However, these are not limited thereto.

Materials for the surface layer are not particularly limited, but are required to decrease surface friction of the intermediate transfer belt 220 to increase cleanability and second transferability of a toner. For example, one, or two or more of a polyurethane resin, a polyester resin and an epoxy resin can reduce a surface energy and increase a lubricity. A powder or a particulate material of one, or two or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

The resin layer and elastic layer include a conductant controlling a resistivity. Specific examples thereof include a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide (ATO) and an indium oxide-tin oxide complex oxide (ITO). The electroconductive metal oxide may be coated with an insulative particulate material such as barium sulfate, magnesium silicate and calcium carbonate. These are not limited thereto.

The intermediate transfer belt 220 preferably has a volume resistivity of from $10^{12}$ to $10^{14}\Omega$cm. When less than $10^{12}\Omega$cm, the toner retentivity on the surface thereof from its first transfer position to second transfer position become insufficient, resulting in toner scattering. When greater than $10^{14}\Omega$cm, the surface thereof from its second transfer position to first transfer position is not sufficiently discharged by an earthed support roller, and the second transfer charge accumulates thereon, resulting in irregularity of the first transfer and the resultant image. To prevent this irregularity of the resultant image, a particular discharger is required, resulting in cost increase. Therefore, the intermediate transfer belt 220 having a volume resistivity of from $10^{12}$ to $10^{14}\Omega$cm prevents the toner scattering and the cost increase due to the particular discharger.

The intermediate transfer belt 220 can be prepared by the following methods, but are not limited thereto, and is typically prepared by combinations of plural methods, such as a centrifugal forming method of feeding materials into a rotating cylindrical mold; a spray coating method of spraying a liquid coating to form a film; a dipping method of dipping a cylindrical mold in a material solution; a casting method of casting materials into an inner mold and an outer mold; and a method of winding a compound around a cylindrical mold to perform a vulcanizing grind.

An embodiment of the method of the intermediate transfer belt 220 will be explained. A cylinder is dipped in a dispersion wherein 100 parts by weight of PVDF, 18 parts by weight of carbon black and 400 parts of toluene are uniformly dispersed, and is slowly pulled up at 10 mm/sec and dried at a room temperature to form a uniform PVDF film 75 μm thick thereon. The cylinder the uniform PVDF film 75 μm thick is formed on is dipped again in the dispersion, and is slowly pulled up at 10 mm/sec and dried at a room temperature to form a PVDF resin layer 150 μm thick thereon. The cylinder the PVDF resin layer 150 μm thick is formed on is dipped in a dispersion wherein 100 parts by weight of polyurethane prepolymer, 3 parts by weight of a hardener (isocyanate), 20 parts by weight of carbon black, 3 parts by weight of a dispersant and 500 parts by weight of MEK are uniformly dispersed, and is pulled up at 30 mm/sec and naturally dried. This is performed again to form a urethane polymer elastic layer 150 μm thick on the resin layer. Further, the cylinder the resin layer and the elastic layer are formed on is dipped in a dispersion wherein 100 parts by weight of polyurethane prepolymer, 3 parts by weight of a hardener (isocyanate), 50 parts by weight of PTFE fine powder, 4 parts by weight of a dispersant and 500 parts by weight of MEK are uniformly dispersed, and is pulled up at 30 mm/sec and naturally dried. This is performed again to form a urethane polymer surface layer 5 μm thick, wherein the PTFE is uniformly dispersed on the elastic layer. After the cylinder the resin layer, the elastic layer and the surface layer are formed on is dried at a room temperature, a crosslinking reaction among the layers is performed for 2 hrs at 130° C. to prepare an intermediate transfer belt including three (3) layers of the resin layer 150 μm thick, the elastic layer 150 μm thick and the surface layer 5 μm thick.

As a method of preventing an elongation of the intermediate transfer belt 220, a method of forming an elastic layer on a center resin layer with less elongation and a method of including an elongation inhibitor in the center resin layer are used, but are not limited thereto. Specific examples of the elongation inhibitor include a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in form of a fabric or a filament. However, these are not limited thereto.

Any twisting methods such as twisted one or plural filaments, a piece twist yarn, a ply yarn and two play yarn can be used. The filament can be subject to an electroconductive treatment. Any fabrics such as a knitted fabric and a mixed weave fabric can be used, and can be subject to an electroconductive treatment.

Specific examples of a method of preparing the center layer include, but is not limited to, a method of covering a cylindrically-woven fabric over a metallic mold and forming a coated layer thereon; a dipping a cylindrically-woven fabric in a liquid rubber and forming a coated layer on one side or both sides thereof; and a method of spirally winding a thread around a metallic mold and forming a coated layer thereon.

When the elastic layer is too thick, expansion and contraction of the surface becomes large and tends to have a crack, although depending on a hardness thereof. When the expansion and contraction of the surface becomes large, the resultant image largely expands and contracts. Therefore, it is not preferable that the elastic layer is too thick, but it preferably has a thickness not less than 1 mm.

The intermediate transfer belt 220 preferably has a hardness of from 10 to 60° (JIS-A). Although the harness differs according to the thickness of the intermediate transfer belt 220, the intermediate transfer belt 220 having a hardness in the range improves the transferability of a toner, and can decrease the recycled toner maintain quality of the resultant images. When less than 10°, an intermediate transfer belt having precise sizes is difficult to form. This is because the belt tends to contract and expand when formed. An oil is typically included in the belt when softened, but the oil exudes when the belt continuously works pressurized. When the oil adheres to the photoreceptors 210Bk, 210C, 210M and 210Y contacting the intermediate transfer belt 220, the photoreceptors deteriorate, resulting in defective resultant images having stripes. Although the surface layer is typically formed on the intermediate transfer belt 220 to improve the releasability thereof, required quality of the surface layer such as durability becomes higher to completely prevent the oil from exuding, resulting in difficulty in selecting materials. The intermediate transfer belt 220 having a hardness of from 10 to 60° can precisely be formed and needs no or less oil, and therefore the photoreceptors less deteriorate.

In this embodiment, the intermediate transfer belt 220 is cleaned, and a drum-shaped intermediate transferer can be cleaned. Further, the cleaner therefor can replace the cleaner for the photoreceptor.

An amorphous silicon photoreceptor (hereinafter referred to as an a-Si photoreceptor) can be used in the present invention. An a-Si photoreceptor can, for example, be formed by heating an electroconductive substrate at from 50 to 400° C. and forming an a-Si photosensitive layer on the substrate by a vacuum deposition method, a sputtering method, an ion plating method, a heat CVD method, a photo CVD method, a plasma CVD method, etc. Particularly, the plasma CVD method is preferably used, which forms an a-Si layer on the substrate by decomposing a gas material with a DC, high-frequency or microwave glow discharge.

FIGS. 3A to 3D are schematic views illustrating a photosensitive layer composition of the amorphous photoreceptor for use in the present invention respectively. An electrophotographic photoreceptor 30 in FIG. 3A includes a substrate 31 and a photosensitive layer 32 thereon, which is photoconductive and formed of a-Si. An electrophotographic photoreceptor 30 in FIG. 3B includes a substrate 31, a photosensitive layer 32 thereon and an a-Si surface layer 33 on the photosensitive layer 32. An electrophotographic photoreceptor 30 in FIG. 3C includes a substrate 31, a charge injection prevention layer 34 thereon, a photosensitive layer 32 on the charge injection prevention layer 34 and an a-Si surface layer 33 on the photosensitive layer 32. An electrophotographic photoreceptor 30 in FIG. 3D includes a substrate 31, a photosensitive layer thereon including a charge generation layer 35 and a charge transport layer 36 formed of a-Si, and an a-Si surface layer 33 on the photosensitive layer.

The substrate of the photoreceptor may either be electroconductive or insulative. Specific examples of the substrate include metals such as Al, Cr, Mo, Au, In, Nb, Te, V, Ti, Pt, Pd and Fe and their alloyed metals such as stainless. In addition, insulative substrates such as films or sheets of synthetic resins such as polyester, polyethylene, polycarbonate, cellulose acetate, polypropylene, polyvinylchloride, polystyrene, polyamide; glasses; and ceramics can be used, provided that at least a surface of the substrate, on which a photosensitive layer is formed, is treated to be electroconductive.

The substrate preferably has the shape of a cylinder, a plate or an endless belt having a smooth or a concave-convex surface. The substrate can have any desired thickness, which can be as thin as possible when an electrophotographic photoreceptor including the substrate is required to have flexibility. However, the thickness is typically not less than 10 μm in terms of production and handling conveniences, and mechanical strength of the electrophotographic photoreceptor.

Figure 3A:
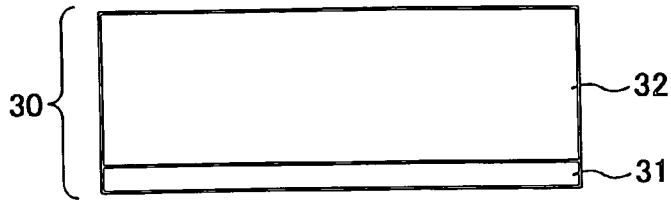
FIGS. 3A to 3D are schematic views illustrating embodiments of photosensitive layer compositions of the amorphous silicone photoreceptor for use in the present invention.
Figure 3B:
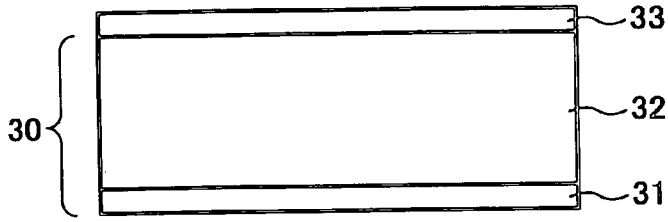
Figure 3C:
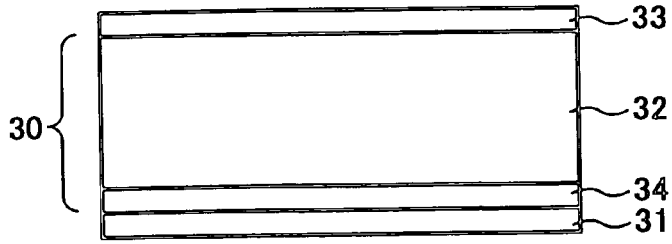
Figure 3D:
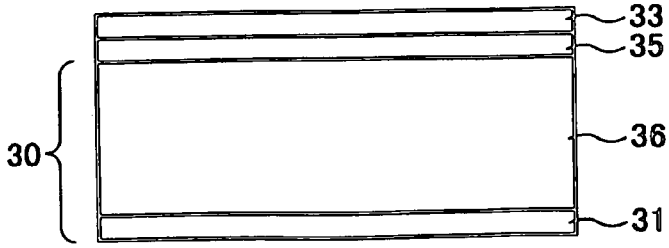

The a-Si photoreceptor of the present invention may optionally include a charge injection prevention layer between the electroconductive substrate and the photosensitive layer in FIG. 3C. When the photosensitive layer is charged with a charge having a certain polarity, the charge injection prevention layer prevents a charge from being injected into the photosensitive layer from the substrate. However, the charge injection prevention layer does not prevent this when the photosensitive layer is charged with a charge having a reverse polarity, i.e., having a dependency on the polarity. The charge injection prevention layer includes more atoms controlling conductivity than the photosensitive layer to have such a capability.

The charge injection prevention layer preferably has a thickness of from 0.1 to 5 μm, more preferably from 0.3 to 4 μm, and most preferably from 0.5 to 3 μm in terms of desired electrophotographic properties and economic effects.

The photosensitive layer 32 is formed on an undercoat layer optionally formed on the substrate 31 and has a thickness as desired, and preferably of from 1 to 100 μm, more preferably from 20 to 50 μm, and most preferably from 23 to 45 μm in terms of desired electrophotographic properties and economic effects.

The charge transport layer is a layer transporting a charge when the photosensitive layer is functionally separated. The charge transport layer includes at least a silicon atom, a carbon atom and a fluorine atom, and optionally includes a hydrogen atom and an oxygen atom. Further, the charge transport layer has photosensitivity, charge retainability, charge generation capability and charge transportability as desired. In the present invention, the charge transport layer preferably includes an oxygen atom.

The charge transport layer has a thickness as desired in terms of electrophotographic properties and economic effects, preferably of from 5 to 50 μm, more preferably from 10 to 40 μm, and most preferably from 20 to 30 μm.

The charge generation layer is a layer generating a charge when the photosensitive layer is functionally separated. The charge generation layer includes at least a silicon atom, does not substantially include a carbon atom and optionally includes a hydrogen atom. Further, the charge generation layer has photosensitivity, charge generation capability and charge transportability as desired.

The charge generation layer has a thickness as desired in terms of electrophotographic properties and economic effects, preferably of from 0.5 to 15 μm, more preferably from 1 to 10 μm, and most preferably from 1 to 5 μm.

The a-Si photoreceptor for use in the present invention can optionally include a surface layer on the photosensitive layer located on the substrate, which is preferably an a-Si surface layer. The surface layer has a free surface and is formed to attain objects of the present invention in humidity resistance, repeated use resistance, electric pressure resistance, environment resistance and durability of the photoreceptor.

The surface layer preferably has a thickness of from 0.01 to 3 μm, more preferably from 0.05 to 2 μm, and most preferably from 0.1 to 1 μm. When less than 0.01 μm, the surface layer is lost due to abrasion during use of the photoreceptor. When greater than 3 μm, deterioration of the electrophotographic properties occurs, such as an increase of residual potential of the photoreceptors.

Figure 4A:
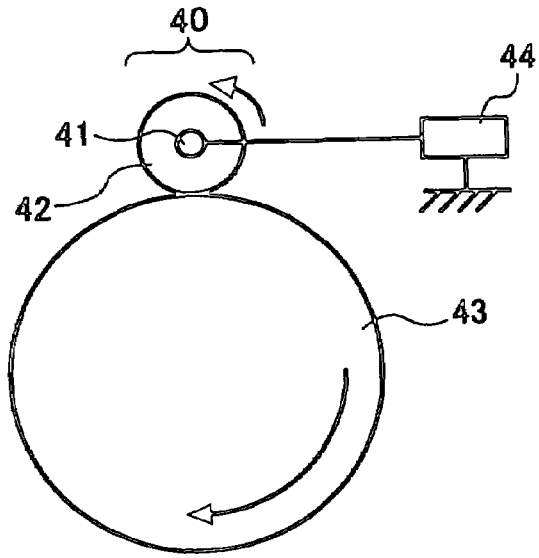
FIG. 4A is a schematic view illustrating an embodiment of the roller charger of the present invention.

FIG. 4A is a schematic view illustrating an embodiment of the image forming apparatus using a contact charger of the present invention. A photoreceptor 43 to be charged and an image bearer rotates at a predetermined speed (process speed) in a direction indicated by an arrow. A roller-shaped charging roller 40 as a charger contacting the photoreceptor is basically formed of a metallic shaft and an electroconductive rubber layer 42 circumferentially and concentrically overlying a metallic shaft 41. Both ends of the metallic shaft 41 are rotatably supported by a bearing (not shown), etc. and the charging roller 40 is pressed against the photoreceptor by a pressurizer (not shown) at a predetermined pressure. In FIG. 4A, the charging roller 40 rotates according to the rotation of the photoreceptor. The charging roller has a preferred diameter of 16 mm because of being formed of a metallic shaft having a diameter of 9 mm and a middle-resistant rubber layer having a resistance of about 100,000Ω·cm coated on the metallic shaft.

The shaft 41 of the charging roller 40 and an electric source 44 are electrically connected with each other, and the electric source 44 applies a predetermined bias to the charging roller 40. Accordingly, a peripheral surface of the photoreceptor 43 is uniformly charged to have a predetermined polarity and a potential.

The charger for use in the present invention may have any form or shape besides the charging roller 40, such as magnetic brushes and fur brushes, and is selectable according to a specification or a form of the electrophotographic image forming apparatus. The magnetic brush is formed of various ferrite particles such as Zn—Cu ferrite as a charging member, a non-magnetic electroconductive sleeve supporting the charging member and a magnet roll included by the non-magnetic electroconductive sleeve. The fur brush is a charger formed of a shaft subjected to an electroconductive treatment and a fur subjected to an electroconductive treatment with, e.g., carbon, copper sulfide, metals and metal oxides winding around or adhering to the shaft.

Figure 4B:
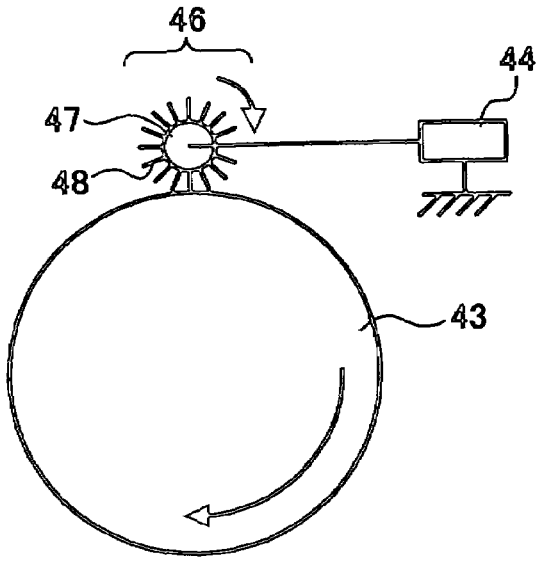
FIG. 4B is a schematic view illustrating an embodiment of the brush charger of the present invention.

FIG. 4B is a schematic view illustrating another embodiment of an image forming apparatus using a contact charger of the present invention. A photoreceptor 43 to be charged and an image bearer rotates at a predetermined speed (process speed) in a direction indicated by an arrow. A brush roller 46 formed of a fur brush contacts a photoreceptor 43 at a predetermined pressure against an elasticity of the brush 48 and a nip width.

The fur brush roller 46 in this embodiment is a roll brush preferably having an outer diameter of 14 mm and a longitudinal length of 250 mm, which is formed of a metallic shaft 47 having a preferred diameter of 6 mm and being an electrode as well, and a pile fabric tape of an electroconductive rayon fiber REC-B® from Unitika Ltd. spirally winding around the shaft as a brush 48. The brush 48 is preferably 300 denier/50 filament and has a density of 155 fibers/mm$^2$. The roll brush is inserted into a pipe preferably having an inner diameter of 12 mm while rotated in a direction such that the brush and pipe are concentrically located, and is left in an environment of high humidity and high temperature to have inclined furs.

The fur brush roller 46 preferably has a resistance of $1\times10^5\Omega$ when the applied voltage is 100 V. The resistance is converted from a current when a voltage of 100 V is applied to the fur brush roller contacting a metallic drum having a preferred diameter of 30 mm at a nip width of 3 mm.

The resistance needs to be not less than $10^4\Omega$ and not greater than $10^7\Omega$ to prevent defect images due to an insufficiently charged nip when a large amount of leak current flows into a defect such as a pin hole on the photoreceptor, and to sufficiently charge the photoreceptor.

Besides the REC-B® from Unitika Ltd., specific examples of the brush material include REC-C®, REC-M1® and REC-M10® therefrom; SA-7® from Toray Industries, Inc.; Thunderon® from Nihon Sanmo Dyeing Co., Ltd.; Belltron® from Kanebo, Ltd.; Clacarbo® from Kuraray Co., Ltd.; carbon-dispersed rayon; and Roval® from MITSUBISHI RAYON CO., LTD. The brush preferably has a denier of from 3 to 10/fiber, a filament of from 10 to 100/batch and a density of from 80 to 600 fibers/mm$^2$. The fiber preferably has a length of from 1 to 10 mm.

The fur brush roller 46 rotates in a direction counter to the rotation direction of the photoreceptor 43 at a predetermined peripheral speed (surface speed) and contacts the surface of the photoreceptor at a different speed. A predetermined charging voltage is applied to the fur brush roller 46 from an electric source to uniformly charge the surface of the photoreceptor to have a predetermined polarity and potential. In this embodiment, the fur brush roller 46 contacts the photoreceptor 43 to charge the photoreceptor, which is dominantly a direct injection charge, and the surface of the photoreceptor is charged to have a potential almost equal to an applied charging voltage to the fur brush roller 46.

The charger for use in the present invention may have any form or shape besides the fur brush roller 46, such as charging rollers and fur brushes, and is selectable according to a specification or a form of the electrophotographic image forming apparatus. The charging roller is typically formed of metallic shaft coated with a middle-resistant rubber layer having a preferred resistance of about 100,000Ω·cm. The magnetic brush is formed of various ferrite particles such as Zn—Cu ferrite as a charging member, a non-magnetic electroconductive sleeve supporting the ferrite particles and a magnet roll included by the non-magnetic electroconductive sleeve.

FIG. 4B is a schematic view illustrating another embodiment of the image forming apparatus using a contact charger of the present invention. A photoreceptor 43 to be charged and an image bearer rotate at a predetermined speed (process speed) in a direction indicated by an arrow. A brush roller 46 formed of a magnetic brush contacts a photoreceptor 43 at a predetermined pressure against an elasticity of the brush 48 and a nip width.

The magnetic brush for use in the present invention as a contact charger includes magnetic particles coated with a middle-resistant resin including a mixture of Zn—Cu ferrite particles preferably having a bimodal average particle diameter of 25 and 10 μm and a mixing weight ratio (25 μm/10 μm) of 1/0.05. The contact charger is formed of the coated magnetic particles, a non-magnetic electroconductive sleeve supporting the magnetic particles and a magnet roll included by the non-magnetic electroconductive sleeve. The coated magnetic particles are coated on the sleeve at a coated thickness of preferably 1 mm to form a charging nip having a preferred width of about 5 mm between the sleeve and photoreceptor, and a gap therebetween is preferably about 500 μm. The magnet roll rotates in a direction counter to the rotation direction of the photoreceptor at a speed of twice as fast as a peripheral speed of a surface of the photoreceptor, such that a surface of the sleeve frictionizes the surface of the photoreceptor and the magnetic brush uniformly contacts the photoreceptor.

The charger for use in the present invention may have any form or shape besides the magnetic brush roller, such as charging rollers and fur brushes, and is selectable according to a specification or a form of the electrophotographic image forming apparatus. The charging roller is typically formed of a metallic shaft coated with a middle-resistant rubber layer having a preferred resistance of about 100,000Ω·cm. The fur brush is a charger formed of a shaft subjected to an electroconductive treatment and a fur subjected to an electroconductive treatment with, e.g., carbon, copper sulfide, metals and metal oxides winding around or adhering to the shaft.

Figure 5:
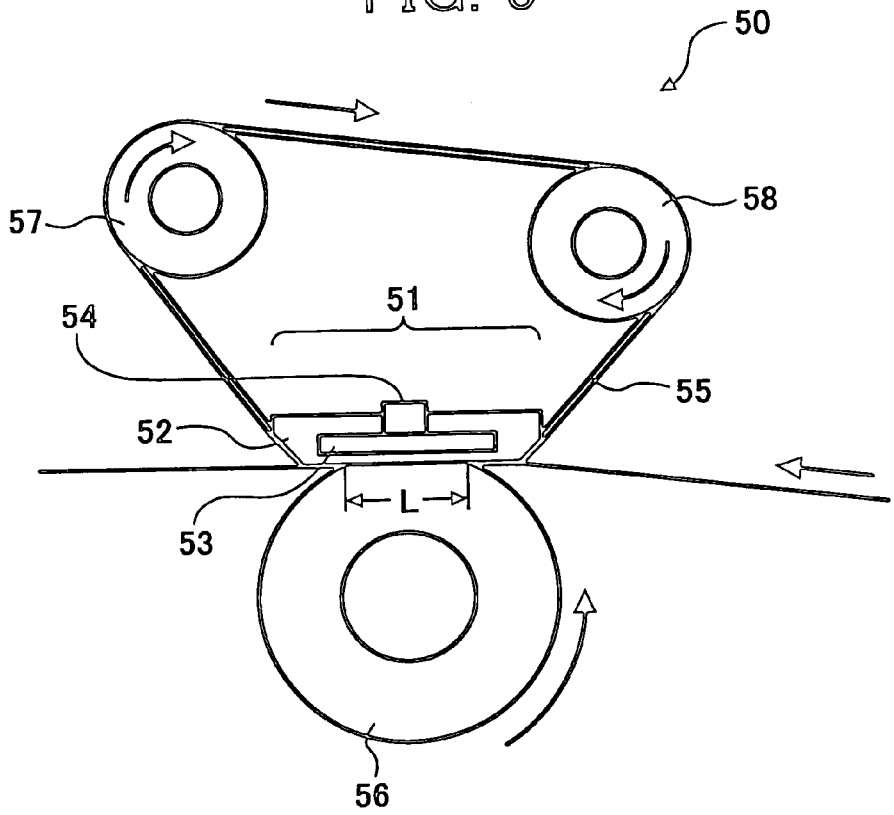
FIG. 5 is a schematic view illustrating an embodiment of the fixer of the present invention.

A fixer 50 for use in the present invention is a surf fixer rotating a fixing film 55 as shown in FIG. 5. The fixing film 55 is a heat resistant film having the shape of an endless belt, which is suspended and strained among a driving roller 57, a driven roller 58 and a heater located therebetween underneath.

The driven roller 58 is a tension roller as well, and the fixing film 55 rotates clockwise according to a clockwise rotation of the driving roller in FIG. 5. The rotational speed of the fixing film 55 is equivalent to that of a transfer material at a fixing nip area L where a pressure roller 56 and the fixing film 55 contact each other.

The pressure roller 56 has a rubber elastic layer having good releasability such as silicone rubbers, and rotates counterclockwise while contacting the fixing nip area L at a total pressure of from 4 to 10 kg.

The fixing film 55 preferably has a good heat resistance, releasability and durability, and has a total thickness not greater than 100 μm, and preferably not greater than 40 μm. Specific examples of the fixing film include, but are not limited to, films formed of a single-layered or a multi-layered film of heat resistant resins such as polyimide, polyetherimide, polyethersulfide (PES) and a tetrafluoroethylene perfluoroalkylvinylether copolymer resin (PFA) having a thickness of 20 μm, on which, contacting an image, is coated a release layer including a fluorocarbon resin such as a tetrafluoroethylene resin (PTFE) and a PFA and an electroconductive material and having a thickness of 10 μm or an elastic layer formed of a rubber such as a fluorocarbon rubber and a silicone rubber.

In FIG. 5, the heater 51 is formed of a flat substrate 52 and a fixing heater 53, and the flat substrate 52 is formed of a material having a high heat conductivity and a high electric resistance such as alumina. The fixing heater 53 formed of a resistance heater is located on a surface of the heater contacting the fixing film in the longitudinal direction of the heater. An electric resistant material such as Ag/Pd and $Ta_2N$ is linearly or zonally coated on the fixing heater by a screen printing method, etc. Both ends of the fixing heater have electrodes (not shown) and the resistant heater generates heat when electricity passes though the electrodes. Further, a fixing temperature sensor 54 formed of a thermistor is located on the side of the substrate 52 opposite to the side on which the fixing heater 53 is located.

Temperature information regarding the substrate, and detected by the fixing temperature sensor 54, is transmitted to a controller controlling electric energy provided to the fixing heater 53 to make the heater have a predetermined temperature.

Figure 6:
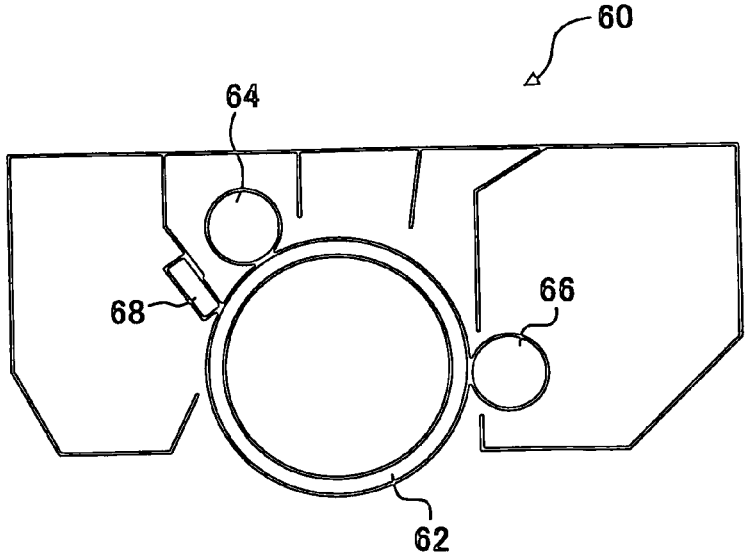
FIG. 6 is a schematic view illustrating an embodiment of the process cartridge of the present invention.

In the present invention, as shown in FIG. 6, a process cartridge 60 including at least two of a photoreceptor 62, a charger 64, an image developer 66 and a cleaner 68 is detachably installed in an image forming apparatus such as a copier and a printer.

In an image forming apparatus using a process cartridge including the developer of the present invention, a photoreceptor rotates at a predetermined peripheral speed. A peripheral surface of the photoreceptor is positively or negatively charged uniformly by a charger while the photoreceptor is rotating to have a predetermined potential. Next, the photoreceptor receives an imagewise light from an irradiator, such as a slit irradiator and a laser beam scanner to form an electrostatic latent image on the peripheral surface thereof. Then, the electrostatic latent image is developed by an image developer with a toner to form a toner image. Next, the toner image is transferred onto a transfer material fed between the photoreceptor and a transferer from a paper feeder in synchronization with the rotation of the photoreceptor. Then, the transfer material which received the toner image is separated from the surface of the photoreceptor and led to an image fixer fixing the toner image on the transfer material to form a copy image which is discharged out of the apparatus. The surface of the photoreceptor is cleaned by a cleaner to remove a residual toner after transfer, and is discharged to repeat forming images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified. Properties of a toner used in each Example are shown in Table 1-1.

EXAMPLES

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 1] of a vinyl resin (a copolymer of a sodium salt of an adduct of styrene-methacrylate-butylacrylate-sulfuric ester with ethyleneoxide methacrylate). The [particulate dispersion liquid 1] was measured by LA-920 to find a volume-average particle diameter thereof was 105 nm. A part of the [particulate dispersion liquid 1] was dried to isolate a resin component therefrom. The resin component had a Tg of 59° C. and a weight-average molecular weight of 150,000.

990 parts of water, 99 parts of the [particulate dispersion liquid 1], 35 parts of an aqueous solution of sodium dodecyldiphenyletherdisulfonate having a concentration of 48.5% (ELEMINOL MON-7 from Sanyo Chemical Industries, Ltd.) and 70 parts of ethyl acetate were mixed and stirred to prepare a lacteous liquid, i.e., an [aqueous phase 1].

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 44 parts of trimellitic acid anhydride were added thereto and the mixture was reacted for 1.8 hrs at a normal pressure and 180° C. to prepare a [low-molecular-weight polyester 1]. The [low-molecular-weight polyester 1] had a number-average molecular weight of 2,500, a weight-average molecular weight of 6,700, a peak molecular weight of 5,000, a Tg of 43° C. and an acid value of 25.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs to prepare an [intermediate polyester 1]. The [intermediate polyester 1] had a number-average molecular weight of 2,100, a weight-average molecular weight of 9,500, a Tg of 55° C. and an acid value of 0.5 and a hydroxyl value of 51.

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

170 parts of isophorondiamine and 75 parts of methyl ethyl ketone were reacted at 50° C. for 5 hrs in a reaction vessel including a stirrer and a thermometer to prepare a [ketimine compound 1]. The [ketimine compound 1] had an amine value of 418.

1,200 parts of water, 540 parts of carbon black PRINTEX 35 from Degussa A. G. having a DBP oil absorption of 42 ml/100 mg and a pH of 9.5, 1,200 parts of the [low-molecular-weight polyester 1] were mixed by a HENSCHEL MIXER from Mitsui Mining Co., Ltd. After the mixture was kneaded by a two-roll mill having a surface temperature of 150° C. for 30 min, the mixture was rolled, cooled and pulverized by a pulverizer to prepare a [master batch 1].

378 parts of the [low-molecular-weight polyester 1], 110 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [master batch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for 1 pass under the same conditions to prepare a [pigment and wax dispersion liquid 1]. The [pigment and wax dispersion liquid 1] had a solid content concentration of 50% at 130° C. for 30 min.

749 parts of the [pigment and wax dispersion liquid 1], 115 parts of the [prepolymer 1] and 2.9 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 12,500 rpm for 30 min. to prepare an [emulsified slurry 1].

The [emulsified slurry 1] was put in a vessel including a stirrer and a thermometer. After a solvent was removed from the emulsified slurry 1 at 35° C. for 7 hrs, the slurry was aged at 45° C. for 4 hrs to prepare a [dispersion slurry 1]. In addition, on the way of removing the solvent, the slurry was stirred by a TK homomixer at 12,500 rpm for 40 min to deform the resultant toner.

After the [dispersion slurry 1] was filtered under reduced pressure, 100 parts of ion-exchange water were added to the filtered cake and mixed by the TK homomixer at 12,000 rpm for 10 min, and the mixture was filtered.

Further, 100 parts of an aqueous solution of 10% sodium hydrate were added to the filtered cake and mixed by the TK homomixer at 12,000 rpm for 30 min, and the mixture was filtered under reduced pressure.

Further, 100 parts of 10% hydrochloric acid were added to the filtered cake and mixed by the TK homomixer at 12,000 rpm for 10 min, and the mixture was filtered.

Further, 300 parts of ion-exchange water were added to the filtered cake and mixed by the TK homomixer at 12,000 rpm for 10 min, and the mixture was filtered. This operation was repeated again to prepare a [filtered cake 1].

The [filtered cake 1] was dried by an air drier at 45° C. for 48 hrs and sieved by a mesh having an opening of 75 μm to prepare a particulate material. After 0.6 parts of a charge controlling agent (a salicylic acid metallic salt E-84 from Orient Chemical Industries, Ltd.) were mixed with 100 parts of the particulate material by a HENSCHEL MIXER, the charge controlling agent was mixed by a Q-type mixer at 5,500 rpm from Mitsui Mining and Smelting Co., Ltd., to be fixed on the surface thereof to prepare a [toner particle 1]. The [toner particle 1] had a weight-average particle diameter of 4.6 μm and a number-average particle diameter of 3.9 μm.

Then, 0.7 parts of hydrophobic titanium oxide was mixed with 100 parts of the [toner particle 1] by a HENSCHEL MIXER to prepare a [toner 1] (black).

Further, the following colorants were used instead of the carbon black to similarly prepare a yellow toner, a magenta toner and a cyan toner.

Namely, instead of 540 parts of the carbon black PRINTEX 35 from Degussa A. G., 1,000 parts of a yellow pigment (disazo yellow pigment C.I. Pigment Yellow 180), 540 parts of a magenta pigment (naphthol pigment C.I. Pigment Red 184) and 400 parts of a cyan pigment (copper phthalocyanine pigment C.I. Pigment Blue 15:3) were used.

On the other hand, the following materials were dispersed by a homomixer for 10 min to prepare a solution for forming a coated film of an acrylic resin and a silicone resin including a particulate alumina.

| | |
|---|---|
| Acrylic resin solution (including a solid content of 50 wt. %) | 21.0 |
| Guanamine solution (including a solid content of 70 wt. %) | 6.4 |
| Particulate alumina (having a particle diameter of 0.3 μm and a resistivity of $10^{14}$ Ω · cm) | 7.6 |
| Silicone resin solution (including a solid content SR2410 of 23% from Dow Corning Toray Silicone Co., Ltd.) | 65.0 |
| Amino silane (including a solid content SH6020 from Dow Corning Toray Silicone Co., Ltd.) | 0.3 |
| Toluene | 60 |
| Butyl cellosolve | 60 |

The solution for forming a coated film was coated on a calcined ferrite powder ($(MgO)_{1.8}(MnO)_{49.5}(Fe_2O_3)_{48.0}$ having an average particle diameter of 35 μm as a core material) by SPIRA COTA from OKADA SEIKO CO., LTD to have a thickness of 0.15 μm, and dried. The dried material was calcined in an electric oven at 150° C. for 1 hr. The calcined material was cooled and sieved with a sieve having an opening of 106 μm to prepare a [carrier 1]. The thickness of the resin coated film can be observed with a transmittance electron microscope by observing a cross-sectional surface of the carrier therewith, and an average of the thickness was determined as the thickness.

Further, 7 parts of the [toner 1] (each color toner) and 93 parts of the [carrier 1] were mixed by a mixer for 10 min to prepare a developer for each color.

The image forming apparatus in FIG. 1 produced high-quality color images having good uniformity of a solid image and thin line reproducibility for long periods with the developer for each color.

Example 2

683 parts of water, 11 parts of a sodium salt of an adduct of a sulfuric ester with ethyleneoxide methacrylate (ELEMINOL RS-30 from Sanyo Chemical Industries, Ltd.), 80 parts of styrene, 83 parts of methacrylate, 110 parts of butylacrylate, 12 parts of butyl thioglycollate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 2] of a vinyl resin (a copolymer of a sodium salt of an adduct of styrene-methacrylate-butylacrylate-sulfuric ester with ethyleneoxide methacrylate). The [particulate dispersion liquid 2] was measured by LA-920 to find a volume-average particle diameter thereof was 120 nm. A part of the [particulate dispersion liquid 2] was dried to isolate a resin component therefrom. The resin component had a Tg of 42° C. and a weight-average molecular weight of 30,000.

The procedure for preparation and of the [toner 1] in Example 1 was repeated except for using the [particulate dispersion liquid 2] instead of the [particulate dispersion liquid 1] to prepare a [toner 2]. The procedure for preparation and evaluation of the developer in Example 1 were repeated except for using the [toner 2] instead of the [toner 1].

Example 3

683 parts of water, 11 parts of a sodium salt of an adduct of a sulfuric ester with ethyleneoxide methacrylate (ELEMINOL RS-30 from Sanyo Chemical Industries, Ltd.), 103 parts of styrene, 83 parts of methacrylate, 90 parts of butylacrylate, 12 parts of butyl thioglycollate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 3] of a vinyl resin (a copolymer of a sodium salt of an adduct of styrene-methacrylate-butylacrylate-sulfuric ester with ethyleneoxide methacrylate). The [particulate dispersion liquid 3] was measured by LA-920 to find a volume-average particle diameter thereof was 110 nm. A part of the [particulate dispersion liquid 3] was dried to isolate a resin component therefrom. The resin component had a Tg of 78° C. and a weight-average molecular weight of 25,000.

The procedure for preparation and of the [toner 1] in Example 1 was repeated except for using the [particulate dispersion liquid 3] instead of the [particulate dispersion liquid 1] to prepare a [toner 3]. The procedure for preparation and evaluation of the developer in Example 1 were repeated except for using the [toner 3] instead of the [toner 1].

Example 4

683 parts of water, 11 parts of a sodium salt of an adduct of a sulfuric ester with ethyleneoxide methacrylate (ELEMINOL RS-30 from Sanyo Chemical Industries, Ltd.), 78 parts of styrene, 83 parts of methacrylate, 115 parts of butylacrylate, 2 parts of butyl thioglycollate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 4] of a vinyl resin (a copolymer of a sodium salt of an adduct of styrene-methacrylate-butylacrylate-sulfuric ester with ethyleneoxide methacrylate). The [particulate dispersion liquid 4] was measured by LA-920 to find a volume-average particle diameter thereof was 110 nm. A part of the [particulate dispersion liquid 4] was dried to isolate a resin component therefrom. The resin component had a Tg of 51° C. and a weight-average molecular weight of 100,000.

The procedure for preparation and of the [toner 1] in Example 1 was repeated except for using the [particulate dispersion liquid 4] instead of the [particulate dispersion liquid 1], and a hydrophobic silica instead of the hydrophobic titanium oxide to prepare a [toner 4].

On the other hand, the following materials were dispersed by a homomixer for 10 min to prepare a solution for forming a coated film of an acrylic resin and a silicone resin including a particulate alumina.

| | |
|---|---|
| Acrylic resin solution (including a solid content of 50 wt. %) | 21.0 |
| Guanamine solution (including a solid content of 70 wt. %) | 6.4 |
| Particulate alumina (having a particle diameter of 0.3 μm and a resistivity of $10^{14}$ Ω · cm) | 121.0 |
| Silicone resin solution (including a solid content SR2410 of 23% from Dow Corning Toray Silicone Co., Ltd.) | 65.0 |
| Amino silane (including a solid content SH6020 from Dow Corning Toray Silicone Co., Ltd.) | 0.3 |
| Toluene | 300 |
| Butyl cellosolve | 300 |

The solution for forming a coated film was coated on a calcined ferrite powder ($(MgO)_{1.8}(MnO)_{49.5}(Fe_2O_3)_{48.0}$ having an average particle diameter of 37 μm as a core material) by SPIRA COTA from OKADA SEIKO CO., LTD to have a thickness of 0.08 μm, and dried. The dried material was calcined in an electric oven at 150° C. for 1 hr. The calcined material was cooled and sieved with a sieve having an opening of 106 μm to prepare a [carrier 2].

Further, 7 parts of the [toner 4] (each color toner) and 93 parts of the [carrier 2] were mixed by a mixer for 10 min to prepare a developer for each color.

The evaluation of the developer in Example 1 was repeated except for using the developer including the [toner 4].

Example 5

683 parts of water, 11 parts of a sodium salt of an adduct of a sulfuric ester with ethyleneoxide methacrylate (ELEMINOL RS-30 from Sanyo Chemical Industries, Ltd.), 68 parts of styrene, 93 parts of methacrylate, 115 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 5] of a vinyl resin (a copolymer of a sodium salt of an adduct of styrene-methacrylate-butylacrylate-sulfuric ester with ethyleneoxide methacrylate). The [particulate dispersion liquid 5] was measured by LA-920 to find a volume-average particle diameter there of was 90 nm. A part of the [particulate dispersion liquid 5] was dried to isolate a resin component therefrom. The resin component had a Tg of 56° C. and a weight-average molecular weight of 150,000.

The procedure for preparation for the [material solution 1] in Example 1 was repeated to prepare a [material solution 2] except for using 110 parts of an ester wax instead of 110 parts the carnauba wax.

1,324 parts of the [material solution 2] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 2] and the mixture was stirred by the beads mill for 1 pass under the same conditions to prepare a [pigment and wax dispersion liquid 2]. The [pigment and wax dispersion liquid 2] had a solid content concentration of 50% at 130° C. for 30 min.

The procedure for preparation and of the [toner 1] in Example 1 was repeated except for using the [particulate dispersion liquid 5] instead of the [particulate dispersion liquid 1], and the [pigment and wax dispersion liquid 2] instead of the [pigment and wax dispersion liquid 1] to prepare a [toner 5].

Further, after 0.6 parts of a charge controlling agent (a salicylic acid metal complex X-11 from Orient Chemical Industries, Ltd.) were mixed with 100 parts of the particulate material by a HENSCHEL MIXER, the charge controlling agent was mixed by a Q-type mixer at 5,500 rpm from Mitsui Mining and Smelting Co., Ltd., to be fixed on the surface thereof.

The procedure for preparation and of the [toner 1] in Example 1 was repeated except for using a hydrophobic silica instead of the hydrophobic titanium oxide to complete a preparation of the [toner 5].

Further, 7 parts of the [toner 5] (each color toner) and 93 parts of the [carrier 2] were mixed by a mixer for 10 min to prepare a developer for each color.

The evaluation of the developer in Example 1 was repeated except for using the developer including the [toner 5].

Example 6

753 parts of the [pigment and wax dispersion liquid 1], 154 parts of the [prepolymer 1] and 3.8 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 13,000 rpm for 20 min to prepare an [emulsified slurry 6].

The procedure for preparation and of the [toner 1] in Example 1 was repeated except for using the [emulsified slurry 6] instead of the [emulsified slurry 1] to prepare a [toner 6].

In addition, on the way of removing the solvent, the slurry was stirred by a TK homomixer at 12,500 rpm for 40 min to deform the resultant toner.

Example 7

196 parts of an adduct of bisphenol A with 2 moles of propyleneoxide, 553 parts of an adduct of bisphenol A with 2 moles of ethyleneoxide, 210 parts terephthalic acid, 79 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 26 parts of trimellitic acid anhydride were added thereto and the mixture was reacted for 2 hrs at a normal pressure and 180° C. to prepare a [low-molecular-weight polyester 2]. The [low-molecular-weight polyester 2] had a number-average molecular weight of 2,400, a weight-average molecular weight of 6,200, a peak molecular weight of 5,200, a Tg of 43° C. and an acid value of 15.

The procedure for preparation and of the [toner 5] in Example 5 was repeated except for using the [low-molecular-weight polyester 2] instead of the [low-molecular-weight polyester 1] to prepare a [toner 7].

In addition, on the way of removing the solvent, the slurry was stirred by a TK homomixer at 13,000 rpm for 30 min to deform the resultant toner.

Comparative Example 1

990 parts of water, 62 parts of the [particulate dispersion liquid 1], 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid, i.e., an [aqueous phase 6].

The procedure for preparation and of the [toner 1] in Example 1 was repeated except for using the [aqueous phase 6] instead of the [aqueous phase 1] to prepare a [toner 8].

Comparative Example 2

990 parts of water, 77 parts of the [particulate dispersion liquid 1], 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid, i.e., an [aqueous phase 7].

The procedure for preparation and of the [toner 1] in Example 1 was repeated except for using the [aqueous phase 7] instead of the [aqueous phase 1] to prepare a [toner 9].

Comparative Example 3

683 parts of water, 11 parts of a sodium salt of an adduct of a sulfuric ester with ethyleneoxide methacrylate (ELEMINOL RS-30 from Sanyo Chemical Industries, Ltd.), 138 parts of styrene, 83 parts of methacrylate, 130 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 6] of a vinyl resin (a copolymer of a sodium salt of an adduct of styrene-methacrylate-butylacrylate-sulfuric ester with ethyleneoxide methacrylate). The [particulate dispersion liquid 6] was measured by LA-920 to find a volume-average particle diameter thereof was 140 nm. A part of the [particulate dispersion liquid 6] was dried to isolate a resin component therefrom. The resin component had a Tg of 152° C. and a weight-average molecular weight of 400,000.

The procedure for preparation and of the [toner 1] in Example 1 was repeated except for using the [particulate dispersion liquid 6] instead of the [particulate dispersion liquid 1] to prepare a [toner 10]. In addition, on the way of removing the solvent, the slurry was stirred by a TK homomixer at 13,000 rpm for 30 min to deform the resultant toner.

Comparative Example 4

683 parts of water, 11 parts of a sodium salt of an adduct of a sulfuric ester with ethyleneoxide methacrylate (ELEMINOL RS-30 from Sanyo Chemical Industries, Ltd.), 63 parts of styrene, 83 parts of methacrylate, 130 parts of butylacrylate, 12 pats of butyl thioglycollate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare an aqueous dispersion a [particulate dispersion liquid 7] of a vinyl resin (a copolymer of a sodium salt of an adduct of styrene-methacrylate-butylacrylate-sulfuric ester with ethyleneoxide methacrylate). The [particulate dispersion liquid 7] was measured by LA-920 to find a volume-average particle diameter thereof was 130 nm. A part of the [particulate dispersion liquid 7] was dried to isolate a resin component therefrom. The resin component had a Tg of 30° C. and a weight-average molecular weight of 5,000.

The procedure for preparation and of the [toner 1] in Example 1 was repeated except for using the [particulate dispersion liquid 7] instead of the [particulate dispersion liquid 1] to prepare a [toner 11].

0.7 parts of a hydrophobic silica were mixed with 100 parts of the [toner 11] by a HENSCEHL MIXER. The properties of the [toner 11] are shown in Table 1-1.

Comparative Example 5

The procedure for preparation of the developer in Example 1 was repeated except for using a [comparative carrier 1] instead of the [carrier 1].

The procedure for preparation of the [carrier 1] was repeated to prepare the [comparative carrier 1] except for using a calcined ferrite powder $(CuO)_{15.5}(ZnO)_{30.0}(Fe_2O_3)_{54.5}$ having an average particle diameter of 35 μm instead of the calcined ferrite powder $(MgO)_{1.8}(MnO)_{49.5}(Fe_2O_3)_{48.0}$ having an average particle diameter of 35 μm as a core material.

Comparative Example 6

The procedure for preparation of the developer in Example 1 was repeated except for using a [comparative carrier 2] instead of the [carrier 1].

The procedure for preparation of the [carrier 1] was repeated to prepare the [comparative carrier 2] except for using a calcined ferrite powder $(MgO)_{1.8}(MnO)_{49.5}(Fe_2O_3)_{48.0}$ having an average particle diameter of 18 μm instead of the calcined ferrite powder $(MgO)_{1.8}(MnO)_{49.5}(Fe_2O_3)_{48.0}$ having an average particle diameter of 35 μm as a core material, and increasing an amount of the solution for forming a coated film twice.

Comparative Example 7

The procedure for preparation of the developer in Example 1 was repeated except for using a [comparative carrier 3] instead of the [carrier 1].

The procedure for preparation of the [carrier 1] was repeated to prepare the [comparative carrier 3] except for using a calcined ferrite powder $(MgO)_{1.8}(MnO)_{49.5}(Fe_2O_3)_{48.0}$ having an average particle diameter of 70 μm instead of the calcined ferrite powder $(MgO)_{1.8}(MnO)_{49.5}(Fe_2O_3)_{48.0}$ having an average particle diameter of 35 μm as a core material, and decreasing an amount of the solution for forming a coated film half.

Comparative Example 8

The procedure for preparation of the developer in Example 1 was repeated except for using a [comparative carrier 4] instead of the [carrier 1].

The procedure for preparation of the [carrier 1] was repeated to prepare the [comparative carrier 4] except for excluding the particulate alumina from the solution for forming a coated film.

Example 8

The following materials were fully mixed by a blender to prepare a mixture, and the mixture was melted and kneaded by a kneader with two rolls heated to have a temperature of from 110 to 120° C. to prepare a kneaded mixture. The kneaded mixture was naturally cooled, coarsely crushed by a cutter mill, finely pulverized by a pulverizer using a jet stream and passed through a wind classifier three times to prepare toner particles. The toner particles were ensphered by a surface reformer, i.e., a surfusing system from Nippon Pneumatic Mfg. Co., Ltd.

| | |
|---|---|
| Binder resin 1 (polyester resin including 0% by weight of THF-insolubles) | 80 |
| Binder resin 2 (urea-modified polyester resin including 10% by weight of THF-insolubles) | 20 |
| Wax (carnauba wax) | 5 |
| Charge Controlling Agent (zinc metal salt of salicylic acid BONTRON E-84 from Orient Chemical Industries Co., Ltd.) | 2 |
| Colorant (carbon black PRINTEX 35 from Degussa A.G.) | 10 |
| 0.7 parts of a hydrophobic silica were mixed with 100 parts of the toner particles by a HENSCEHL MIXER to prepare a [toner 12]. | |

Further, 7 parts of the [toner 12] (each color toner) and 93 parts of the [carrier 2] were mixed by a mixer for 10 min to prepare a developer for each color. The procedure for evaluation of the developer in Example 1 was repeated except for using the [toner 12] instead of the [toner 1].

Evaluated Items

Granularity

Differently from dot reproducibility typically considered an index for high-quality images, the granularity is determined as a subjective evaluated value for roughness of an image. The RMS granularity is a standardized granularity in ANSI PH-2.40-1985 wherein the subjective evaluated value for roughness is objectified.

Dooley and Shaw at Xerox cascaded and integrated the Winer Spectrum and Visual transfer Function (VTF) to determine a granularity (GS) using the following formula:

$$GS=\exp(-1.8D)\int(WS(f))^{1/2}VTF(f)df$$

wherein D represents an average density; f represents a spatial frequency (c/mm); and WS(f) represents the Winer Spectrum.

Thin Line Reproducibility

A thin line image having 600 dpi was produced on TYPE 6000 paper from Ricoh Company, Ltd. to compare a blurred degree thereof with that of a level sample. The level becomes better in this order, i.e., ◎>○>Δ>X.

Cleanability

A halftone solid image was formed on the photoreceptor, and the toner thereon was cleaned with a blade without being transferred onto a recording member to see if the toner remained thereon.

SUMMARY OF THE EXAMPLES AND COMPARATIVE EXAMPLES

TABLE 1-1

| | Toner Properties | | | | |
|---|---|---|---|---|---|
| | D4 | Dn | D4/Dn | SF-1 | Average circularity |
| The range of the present invention | 3.0 to 8.0 | | 1.01 to 1.20 | 120 to 160 | 0.93 to 0.98 |
| Example 1 | 4.6 | 3.9 | 1.18 | 140 | 0.96 |
| Example 2 | 5.6 | 4.8 | 1.17 | 136 | 0.96 |

TABLE 1-1-continued

| | Toner Properties | | | | |
|---|---|---|---|---|---|
| | D4 | Dn | D4/Dn | SF-1 | Average circularity |
| Example 3 | 6.6 | 6.1 | 1.08 | 133 | 0.96 |
| Example 4 | 6.4 | 5.5 | 1.16 | 145 | 0.95 |
| Example 5 | 3.7 | 3.3 | 1.12 | 130 | 0.97 |
| Example 6 | 5.5 | 4.7 | 1.17 | 154 | 0.93 |
| Example 7 | 4.0 | 3.4 | 1.18 | 156 | 0.93 |
| Comparative Example 1 | 8.3 | 6.4 | 1.30 | 125 | 0.97 |
| Comparative Example 2 | 5.7 | 4.3 | 1.33 | 118 | 0.98 |
| Comparative Example 3 | 6.2 | 5.2 | 1.19 | 165 | 0.92 |
| Comparative Example 4 | 2.7 | 2.3 | 1.17 | 125 | 0.98 |
| Comparative Example 5 | | | Same as those of Example 1 | | |
| Comparative Example 6 | | | Same as those of Example 1 | | |
| Comparative Example 7 | | | | | |
| Comparative Example 8 | | | | | |
| Example 8 | 6.5 | 5.5 | 1.18 | 120 | 0.98 |

TABLE 1-2

| | Evaluation Results | | | |
|---|---|---|---|---|
| | Granularity | Image resolution | Defective cleaning | Overall assessment |
| Example 1 | 0.25 | ◎ | None | ○ |
| Example 2 | 0.23 | ◎ | None | ○ |
| Example 3 | 0.25 | ◎ | None | ○ |
| Example 4 | 0.26 | ◎ | None | ○ |
| Example 5 | 0.22 | ◎ | None | ○ |
| Example 6 | 0.24 | ◎ | None | ○ |
| Example 7 | 0.23 | ◎ | None | ○ |
| Comparative Example 1 | 0.66 | X | None | X |
| Comparative Example 2 | 0.52 | ○ | Occurred | X |
| Comparative Example 3 | 0.45 | X | None | X |
| Comparative Example 4 | 0.23 | ◎ | Occurred | X |
| Comparative Example 5 | 0.49 | Δ | None | X |
| Comparative Example 6 | 0.22 | ◎ | Occurred | X |
| Comparative Example 7 | 0.55 | X | None | X |
| Comparative Example 8 | 0.48 | Δ | None | X |
| Example 8 | 0.26 | ○ | Occurred | ○ |

Summary of Toner Preparation Conditions

TABLE 2-1

| | Organic emulsion | Aqueous phase | Low-molecular-Weight Polyester | Intermediate Polyester | Ketimine | Master batch | Oil phase | |
|---|---|---|---|---|---|---|---|---|
| Ex. 1 | Particulate dispersion liquid 1 | Aqueous phase i | Low-molecular-Weight Polyester 1 | Prepolymer 1 | Ketimine compound 1 | Master batch 1 | Material solution 1 | Pigment and wax dispersion 1 |
| Ex. 2 | Particulate dispersion liquid 2 | Aqueous phase 2 | Low-molecular-Weight Polyester 1 | " | " | " | " | Pigment and wax dispersion 1 |
| Ex. 3 | Particulate dispersion liquid 3 | Aqueous phase 3 | Low-molecular-Weight Polyester 1 | " | " | " | " | Pigment and wax dispersion 1 |
| Ex. 4 | Particulate dispersion liquid 4 | Aqueous phase 4 | Low-molecular-Weight Polyester 1 | " | " | " | " | Pigment and wax dispersion 1 |
| Ex. 5 | Particulate dispersion liquid 5 | Aqueous phase 5 | Low-molecular-Weight Polyester 1 | " | " | " | Material solution 2 | Pigment and wax dispersion 2 |
| Ex. 6 | Particulate dispersion liquid 1 | Aqueous phase i | Low-molecular-Weight Polyester 1 | " | " | " | Material solution 1 | Pigment and wax dispersion 1 |
| Ex. 7 | Particulate dispersion liquid 5 | Aqueous phase 5 | Low-molecular-Weight Polyester 2 | " | " | " | Material solution 3 | Pigment and wax dispersion 3 |
| Com. Ex. 1 | Particulate dispersion liquid 1 | Aqueous phase 6 | Low-molecular-Weight Polyester 1 | " | " | " | Material solution 1 | Pigment and wax dispersion 1 |
| Com. Ex. 2 | Particulate dispersion liquid 1 | Aqueous phase 7 | Low-molecular-Weight Polyester 1 | " | " | " | " | Pigment and wax dispersion 1 |
| Com. Ex. 3 | Particulate dispersion liquid 6 | Aqueous phase 8 | Low-molecular-Weight Polyester 1 | " | " | " | " | Pigment and wax dispersion 1 |
| Com. Ex. 4 | Particulate dispersion liquid 7 | Aqueous phase 9 | Low-molecular-Weight Polyester 1 | " | " | " | " | Pigment and wax dispersion 1 |
| Com. Ex. 5 | Particulate dispersion liquid 1 | Aqueous phase 1 | Low-molecular-Weight Polyester 1 | " | " | " | " | Pigment and wax dispersion 1 |

TABLE 2-1-continued

| | Organic emulsion | Aqueous phase | Low-molecular-Weight Polyester | Intermediate Polyester | Ketimine | Master batch | Oil phase |
|---|---|---|---|---|---|---|---|
| Com. Ex. 6 | Particulate dispersion liquid 1 | Aqueous phase 1 | Low-molecular-Weight Polyester 1 | " | " | " | " Pigment and wax dispersion 1 |
| Com. Ex. 7 | Particulate dispersion liquid 1 | Aqueous phase 1 | Low-molecular-Weight Polyester 1 | " | " | " | " Pigment and wax dispersion 1 |
| Com. Ex. 8 | Particulate dispersion liquid 1 | Aqueous phase 1 | Low-molecular-Weight Polyester 1 | " | " | " | " Pigment and wax dispersion 1 |
| Ex. 8 | | | | Kneading, Pulverizing and classifying method | | | |

TABLE 2-2

| | Emulsification | Aging | Washing and filtering | Drying | Carrier |
|---|---|---|---|---|---|
| Example 1 | Emulsified slurry 1 | Dispersion slurry 1 | Filtered cake 1 | Toner 1 | Carrier 1 |
| Example 2 | Emulsified slurry 2 | Dispersion slurry 2 | Filtered cake 2 | Toner 2 | Carrier 1 |
| Example 3 | Emulsified slurry 3 | Dispersion slurry 3 | Filtered cake 3 | Toner 3 | Carrier 1 |
| Example 4 | Emulsified slurry 4 | Dispersion slurry 4 | Filtered cake 4 | Toner 4 | Carrier 2 |
| Example 5 | Emulsified slurry 5 | Dispersion slurry 5 | Filtered cake 5 | Toner 5 | Carrier 2 |
| Example 6 | Emulsified slurry 6 | Dispersion slurry 6 | Filtered cake 6 | Toner 6 | Carrier 2 |
| Example 7 | Emulsified slurry 7 | Dispersion slurry 7 | Filtered cake 7 | Toner 7 | Carrier 2 |
| Comparative Example 1 | Emulsified slurry 8 | Dispersion slurry 8 | Filtered cake 8 | Toner 8 | Carrier 1 |
| Comparative Example 2 | Emulsified slurry 9 | Dispersion slurry 9 | Filtered cake 9 | Toner 9 | Carrier 1 |
| Comparative Example 3 | Emulsified slurry 10 | Dispersion slurry 10 | Filtered cake 10 | Toner 10 | Carrier 1 |
| Comparative Example 4 | Emulsified slurry 11 | Dispersion slurry 11 | Filtered cake 11 | Toner 11 | Carrier 1 |
| Comparative Example 5 | Emulsified slurry 1 | Dispersion slurry 1 | Filtered cake 1 | Toner 1 | Comparative carrier 1 |
| Comparative Example 6 | Emulsified slurry 1 | Dispersion slurry 1 | Filtered cake 1 | " | Comparative carrier 2 |
| Comparative Example 7 | Emulsified slurry 1 | Dispersion slurry 1 | Filtered cake 1 | " | Comparative carrier 3 |
| Comparative Example 8 | Emulsified slurry 1 | Dispersion slurry 1 | Filtered cake 1 | " | Comparative carrier 4 |
| Example 8 | | — | | Toner 12 | Carrier 2 |

This application claims priority and contains subject matter related to Japanese Patent Application No. 2004-141523 filed on May 11, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A developer for an electrophotographic tandem image forming method, comprising:

a toner; and a carrier, wherein the toner has a shape factor SF-1 of from 120 to 160, an average circularity of from 0.93 to 0.98, a weight-average particle diameter (D4) of from 3.0 to 8.0 μm, and a ratio (D4/Dn) of the weight-average particle diameter (D4) to a number-average particle diameter (Dn) of from 1.01 to 1.20, and wherein the carrier comprises ferrite particles coated with a resin having alumina dispersed therein, wherein the carrier has an average particle diameter of from 20 to 45 μm and the following formula:

$$(MgO)x(MnO)y(Fe_2O_3)z$$

wherein x is from 1 to 5 mol %, y is from 5 to 55 mol % and z is from 45 to 55 mol %.

2. The developer of claim 1, wherein the toner further comprises a hard fine powder having a particle diameter of from 0.01 to 0.3 μm.

3. The developer of claim 1, wherein the toner further comprises, on a surface thereof, an inorganic particulate material having an average particle diameter of from 0.05 to 0.6 μm.

4. The developer of claim 1, wherein the toner further comprises a release agent in an amount of from 3 to 10% by weight based on total weight of the toner.

5. The developer of claim 1, wherein the toner is prepared by a method comprising:

dispersing a droplet particulate material forming a dispersion in which drops comprising an organic solvent, a resin and a colorant are dispersed in an aqueous medium comprising a particulate resin material; and removing the organic solvent from the dispersion liquid.

6. The developer of claim 1, wherein the carrier comprises spherical ferrite particles coated with a resin having alumina dispersed therein.

7. An electrophotographic tandem image forming method comprising:

charging at least one electrophotographic photoreceptor with a charger to form an electrostatic latent image on the at least one photoreceptor;

developing the electrostatic latent image with a developer according to claim 1 and an image developer to form a toner image thereon;

transferring the toner image onto a recording medium with a transferer; and fixing with a fixer the toner image thereon.

8. The electrophotographic tandem image forming method of claim 7, wherein the transferring comprises an intermediate transferring comprising:

transferring the toner image onto an intermediate transferer; and transferring the toner image onto the recording medium with the intermediate transferer.

9. The electrophotographic tandem image forming method of claim 7, wherein the at least one photoreceptor is an amorphous silicon photoreceptor.

10. The electrophotographic tandem image forming method of claim 7, wherein the charging comprises:

contacting the charger to the at least one photoreceptor; and applying a voltage to the charger.

11. The electrophotographic tandem image forming method of claim 7, wherein the developing comprises:

bearing the developer with a developer bearer; and applying only a DC voltage thereto.

12. The electrophotographic tandem image forming method of claim 7, wherein the fixing comprises:

passing the recording medium through a heated film and a pressurizer to fix the toner image thereon upon application of heat.

13. The electrophotographic tandem image forming method of claim 7, wherein the toner further comprises a hard fine powder having a particle diameter of from 0.01 to 0.3 μm.

14. The electrophotographic tandem image forming method of claim 7, wherein the toner further comprises, on a surface thereof, an inorganic particulate material having an average particle diameter of from 0.05 to 0.6 μm.

15. The electrophotographic tandem image forming method of claim 7, wherein the toner further comprises a release agent in an amount of from 3 to 10% by weight based on total weight of the toner.

16. The electrophotographic tandem image forming method of claim 7, wherein the toner is prepared by a method comprising:

dispersing a droplet particulate material forming a dispersion in which drops comprising an organic solvent, a resin and a colorant are dispersed in an aqueous medium comprising a particulate resin material; and removing the organic solvent from the dispersion liquid.

17. The electrophotographic tandem image forming method of claim 7, wherein the carrier comprises spherical ferrite particles coated with a resin having alumina dispersed therein.

18. The developer according to claim 1, wherein the resin coating the ferrite particles comprises an acrylic resin and a silicone resin, wherein the resin comprises the acrylic resin in an amount of from 10 to 90% by weight.

19. The developer according to claim 18, wherein the resin coating the ferrite particles further comprises at least one crosslinkable component.

20. The developer according to claim 19, wherein the at least one crosslinkable component is at least one member selected from the group consisting of amino resins and acidic catalysts.

* * * * *